US005304999A

United States Patent [19]

Roberts et al.

[11] Patent Number: 5,304,999

[45] Date of Patent: Apr. 19, 1994

[54] POLARIZATION AGILITY IN AN RF RADIATOR MODULE FOR USE IN A PHASED ARRAY

[75] Inventors: Roger G. Roberts, Auburn; Thomas E. Sharon, Alpharetta, both of Ga.

[73] Assignee: Electromagnetic Sciences, Inc., Norcross, Ga.

[21] Appl. No.: 795,026

[22] Filed: Nov. 20, 1991

[51] Int. Cl.[5] ..... H01Q 3/36; H01P 1/161; H01P 5/16; H01P 1/18

[52] U.S. Cl. ..... 343/778; 343/756; 333/117; 333/21 A; 333/24.1; 333/158

[58] Field of Search ..... 333/117, 109, 21 A, 333/24.1, 158; 343/756, 778, 772

[56] References Cited

U.S. PATENT DOCUMENTS

| | | | |
|---|---|---|---|
| 2,850,701 | 9/1958 | Fox | 333/21 A X |
| 3,411,113 | 11/1968 | Heithaus | 333/24.1 |
| 3,453,621 | 7/1969 | Roney et al. | 343/756 X |
| 3,500,460 | 3/1970 | Jones et al. | 333/24.1 X |
| 3,544,999 | 12/1970 | Michelson | 333/24.1 X |
| 3,698,008 | 10/1972 | Roberts et al. | 333/24.1 X |
| 3,938,158 | 2/1976 | Birch et al. | 343/756 |
| 4,445,098 | 4/1984 | Sharon et al. | 333/1.1 |
| 4,737,793 | 4/1988 | Munson et al. | 342/361 |
| 4,884,045 | 11/1989 | Alverson et al. | 333/158 |
| 4,965,868 | 10/1990 | Wong et al. | 333/117 X |
| 5,075,648 | 12/1991 | Roberts et al. | 333/128 |
| 5,089,716 | 2/1992 | Wallis et al. | 307/101 |

OTHER PUBLICATIONS

Patent Abstracts of Japan, vol. 8, No. 217 (E-270), Oct. 4 1984 & JP-A-59 101 904 (Mitsubishi Denki K.K.) Jun. 12 1984 (Abstract).

Patent Abstracts of Japan, vol. 8, No. 217 (E-270) (1654) Oct. 4, 1984 & JP-A-59 101 905 (Mitsubishi Denki K.K.) Jun. 12, 1984 (Abstract).

Patent Abstracts of Japan, vol. 3, No. 66 (E-115) Jun. 7, 1979 & JP-A-54 043 659 (Boeicho Gijutsu Kenkyu Honbu (Japan)) Apr. 6, 1979 (Abstract).

"Designing With The Double Lange Coupler", Contest Prize Winner Analyzes Interdigitated Design, by Derek Fitzgerald, RF Design Feature, Oct. 1988, pp. 46–48.

"A Collection of Writings Pertaining to Fast Switching, Ferrite Phase Shifters," Mar. 20, 1991, by Electromagnetic Sciences, Inc., Norcross, Ga.

*Primary Examiner*—Benny T. Lee

*Attorney, Agent, or Firm*—Nixon & Vanderhye

[57] ABSTRACT

A 90° coupling circuit cascaded with a pair of hybrid mode latchable phase shifters provides polarization agility for an RF radiator module of the type typically used in a phased array. For example, such radiator modules typically may utilize an active microwave integrated circuit (MIC), a monolithic microwave integrated circuit (MMIC) or a passive reciprocal hybrid mode element (RHYME) circuit. These circuits are arranged to provide duplex RF transmit/receive functions with controllable phase shifts at each radiator site in a phased array. By appropriately setting the two controllable phase shifters to different combinations of phase shifts (e.g., 0° and/or 90°) to a dual orthogonal mode radiator, different spatial polarizations for RF radiator transmit/receive functions can be defined. The radiator itself may include a square or circular waveguide including, in some cases, a reciprocal dielectric quarter-wave plate and a non-reciprocal ferrite quarter-wave plate. If a square waveguide is utilized, then 0°, 90° hybrid mode latchable phase shifters may be arranged on either side of a common ground plane with direct waveguide coupling into a septum polarizer waveguide section of the radiator element. A 90° Lange hybrid coupler also may be used by itself in conjunction with an electrically rotatable ferrite quarter-wave plate radiating element to achieve a certain degree of polarization agility.

25 Claims, 20 Drawing Sheets

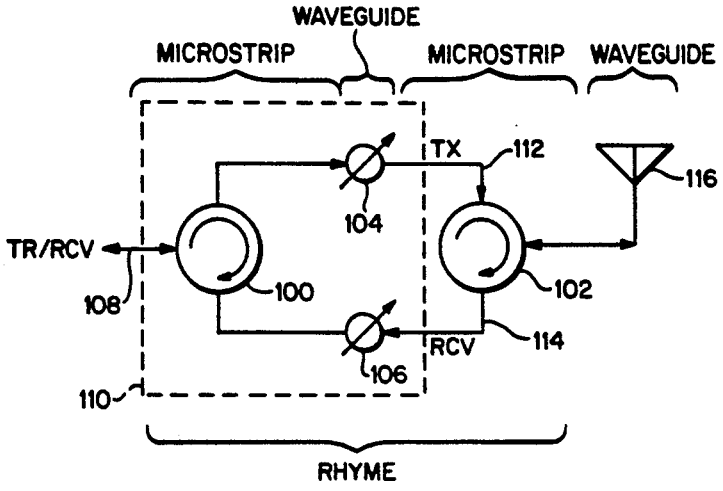
FIG. 1 (PRIOR ART)
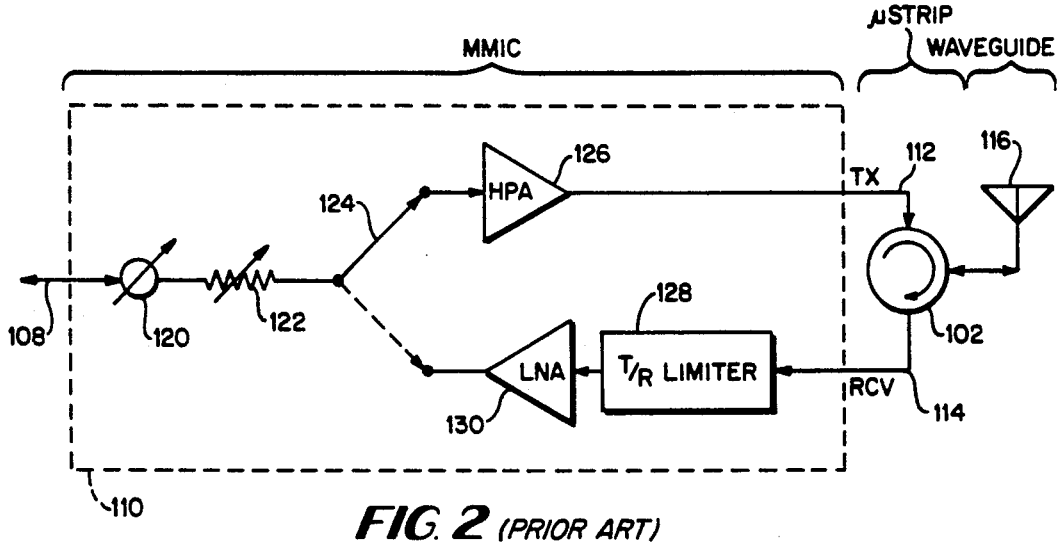
FIG. 2 (PRIOR ART)
FIG. 3
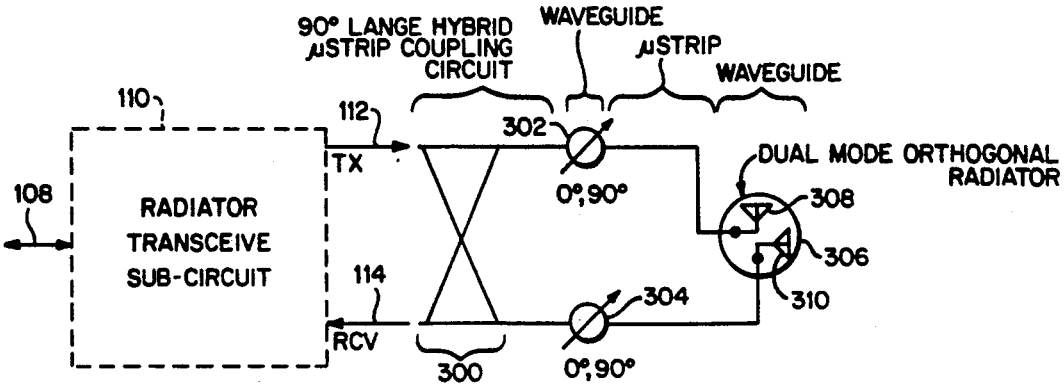

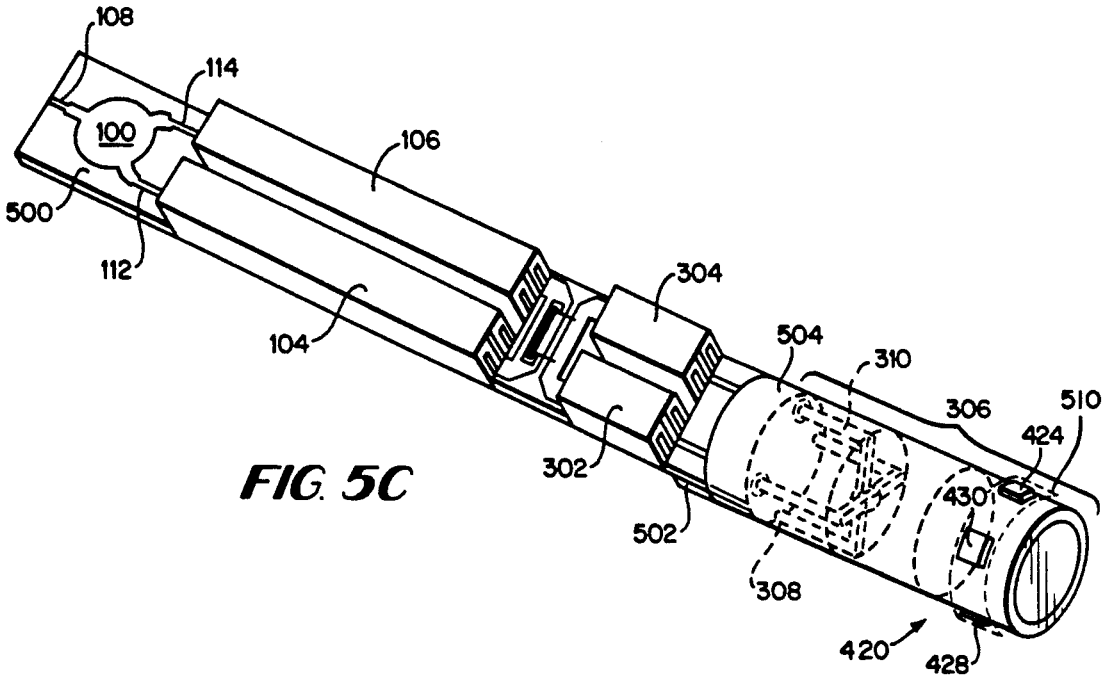
FIG. 5C
FIG. 5D
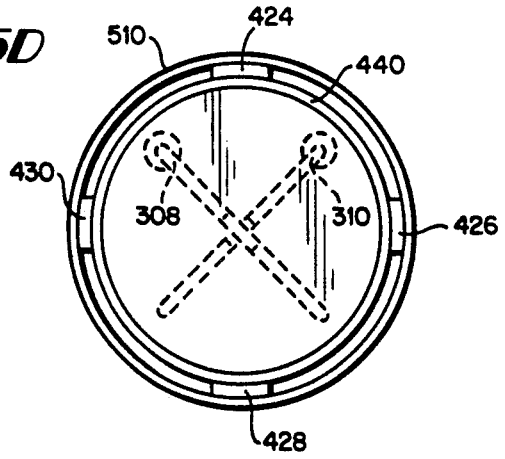

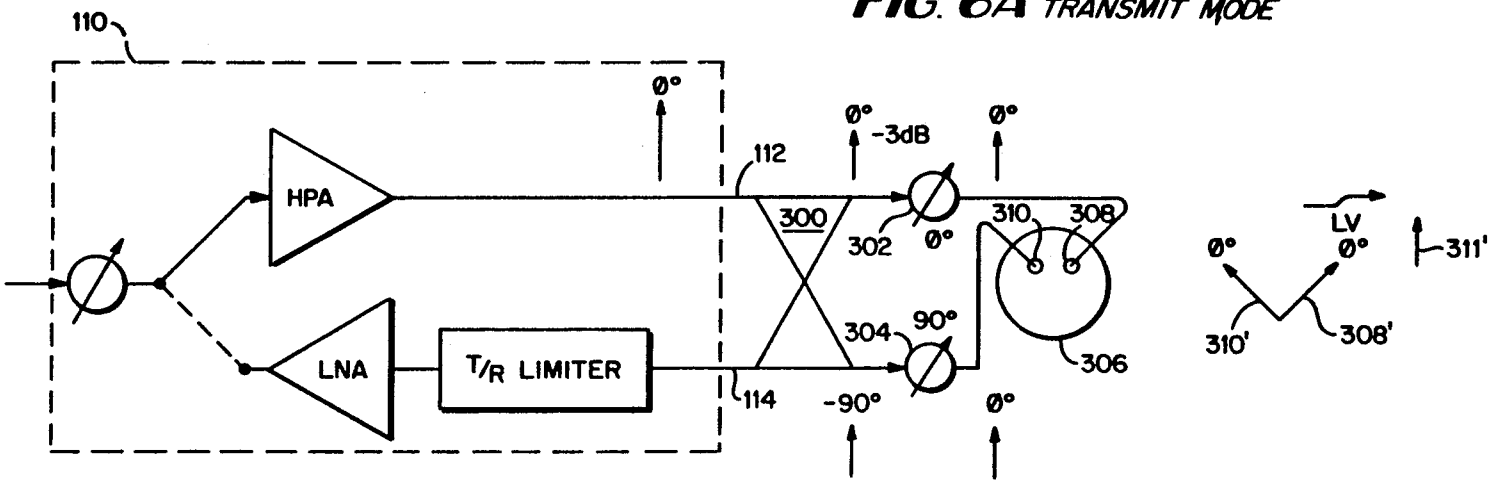
FIG. 6A TRANSMIT MODE
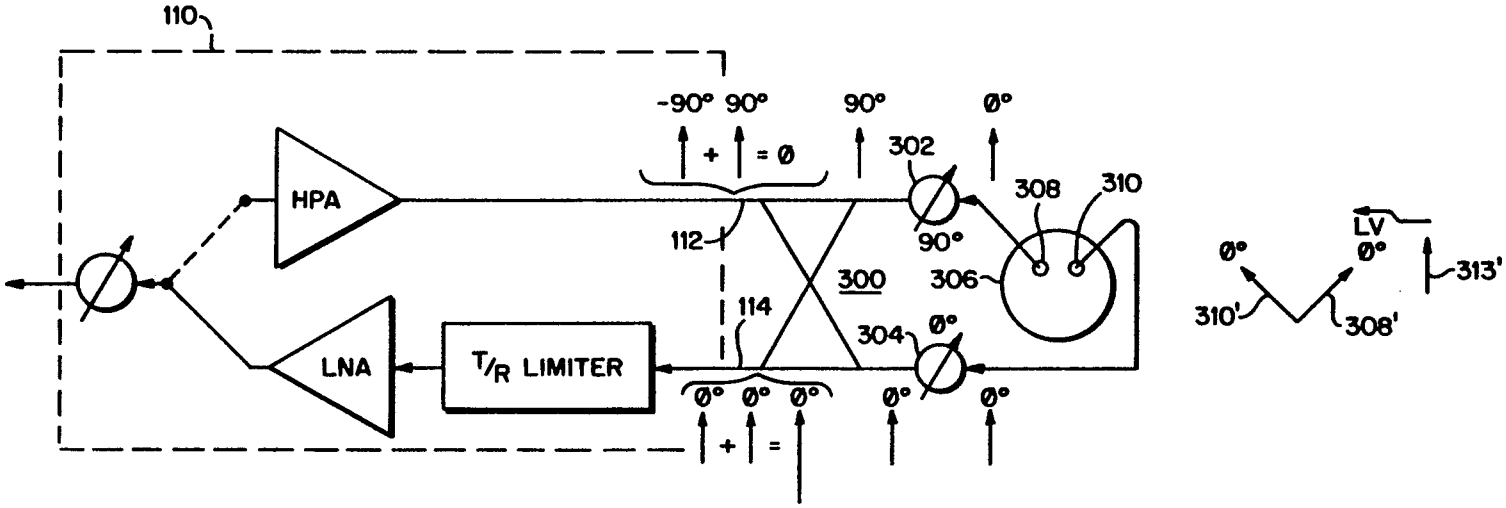
FIG. 6B RECEIVE MODE

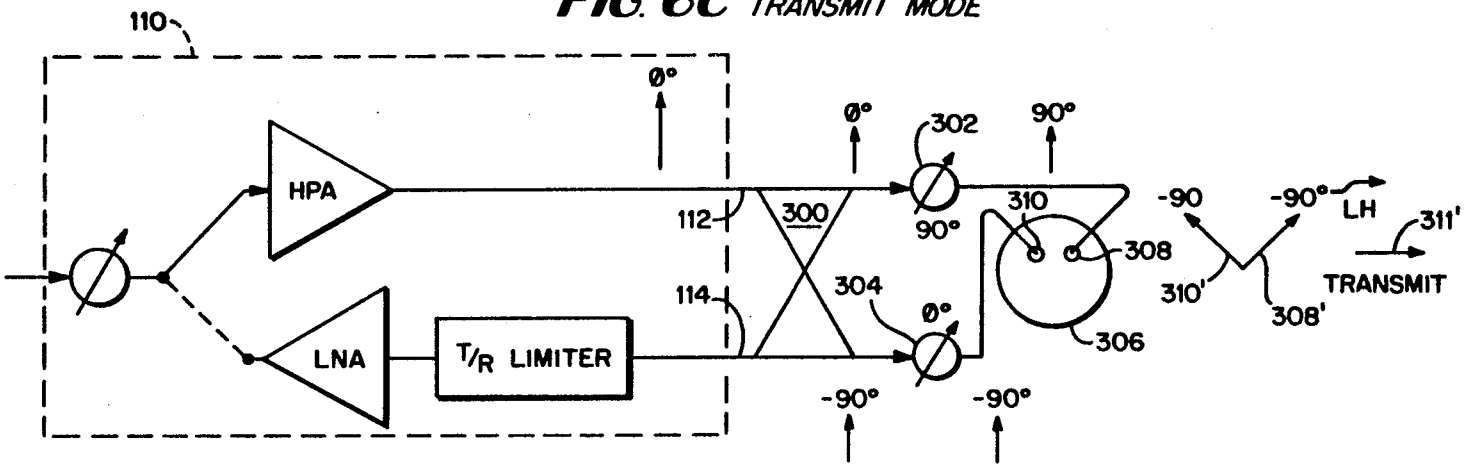
FIG. 6C TRANSMIT MODE
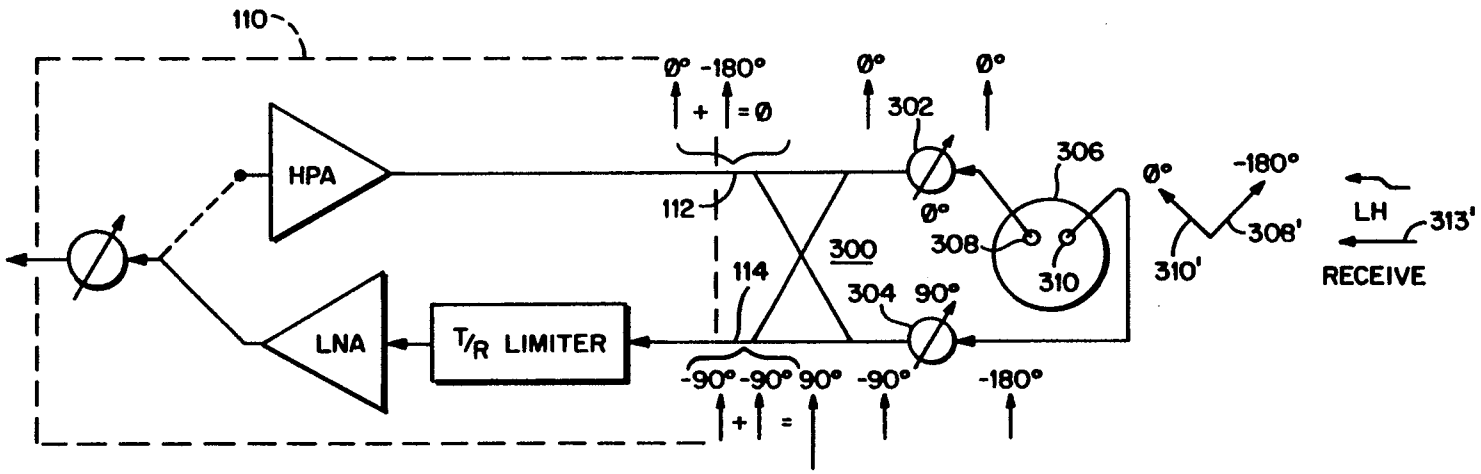
FIG. 6D RECEIVE MODE

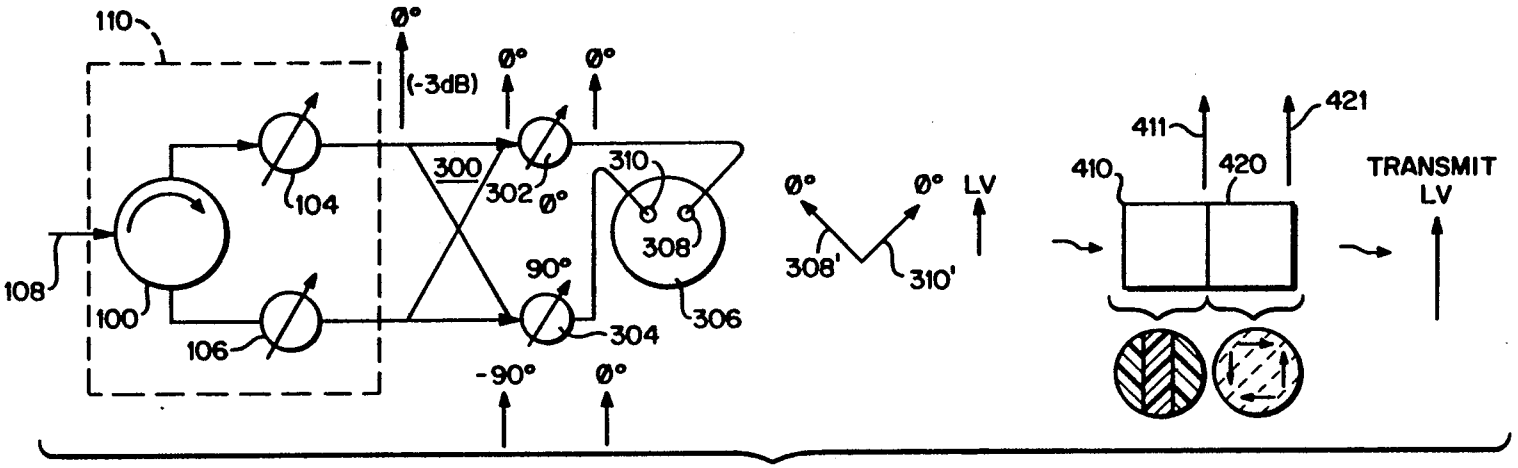
FIG. 7A TRANSMIT MODE
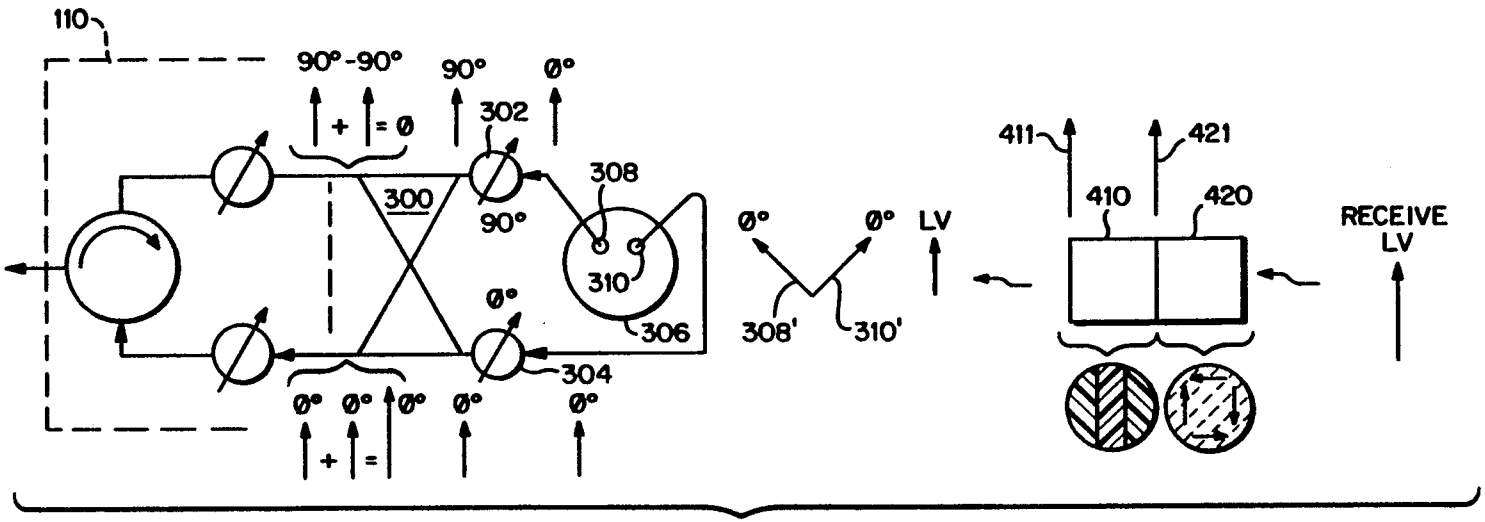
FIG. 7B RECEIVE MODE

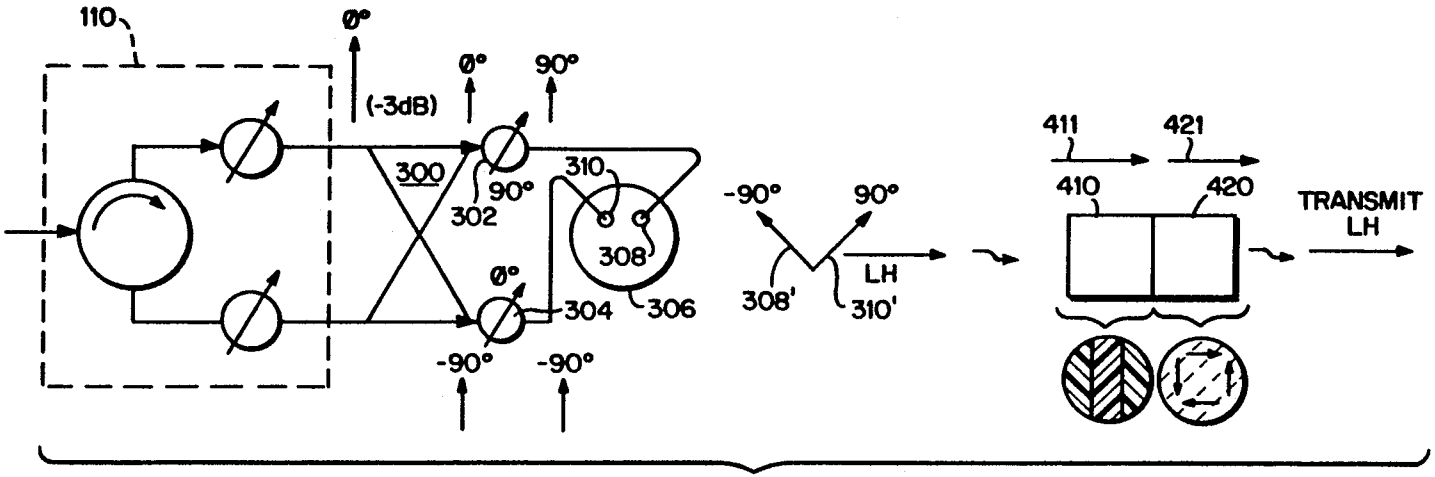
FIG. 7C TRANSMIT MODE
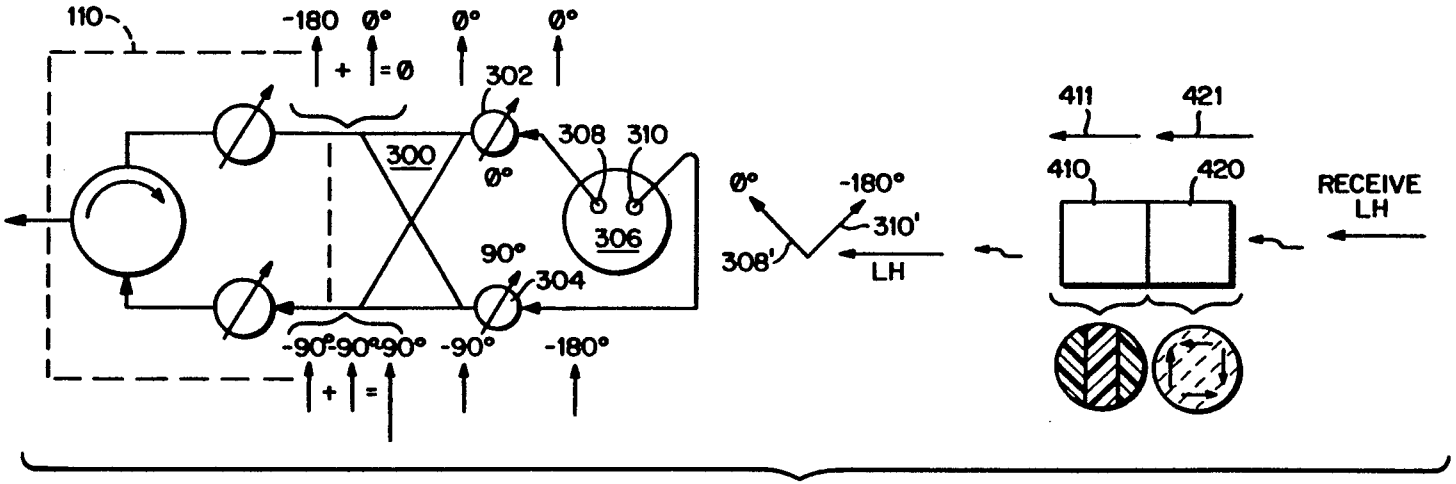
FIG. 7D RECEIVE MODE

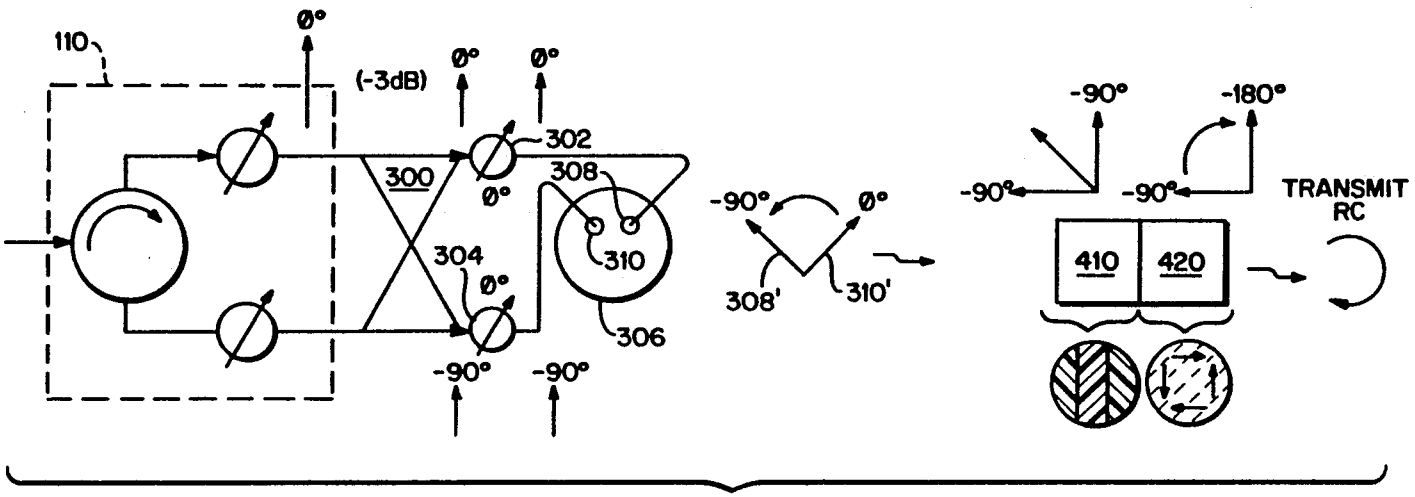
FIG. 7E TRANSMIT MODE
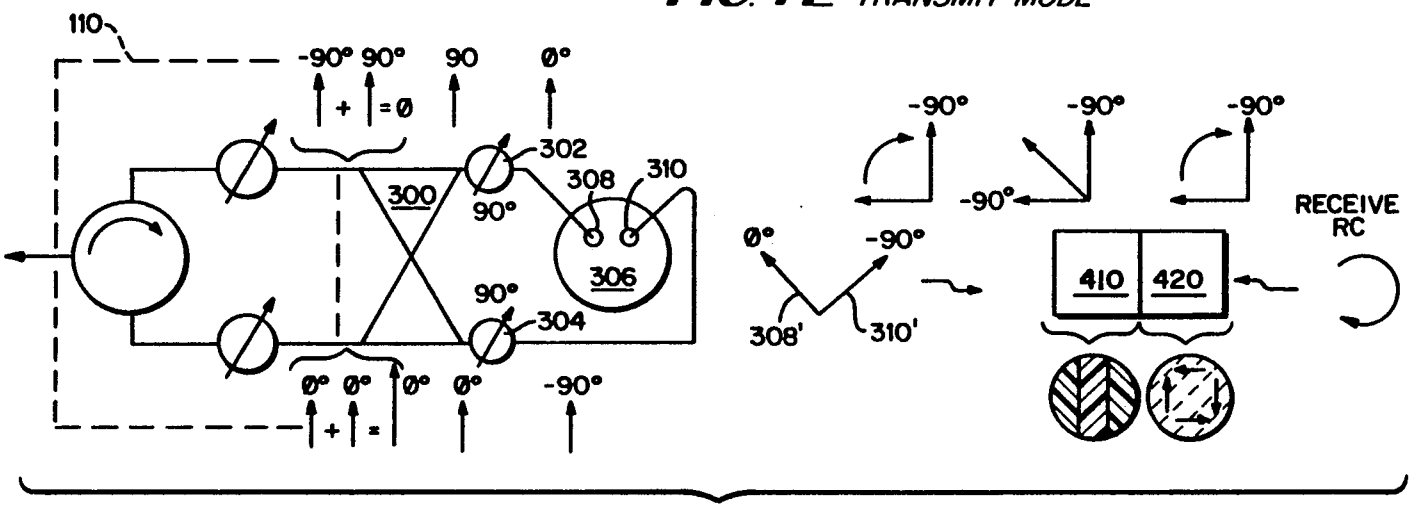
FIG. 7F RECEIVE MODE

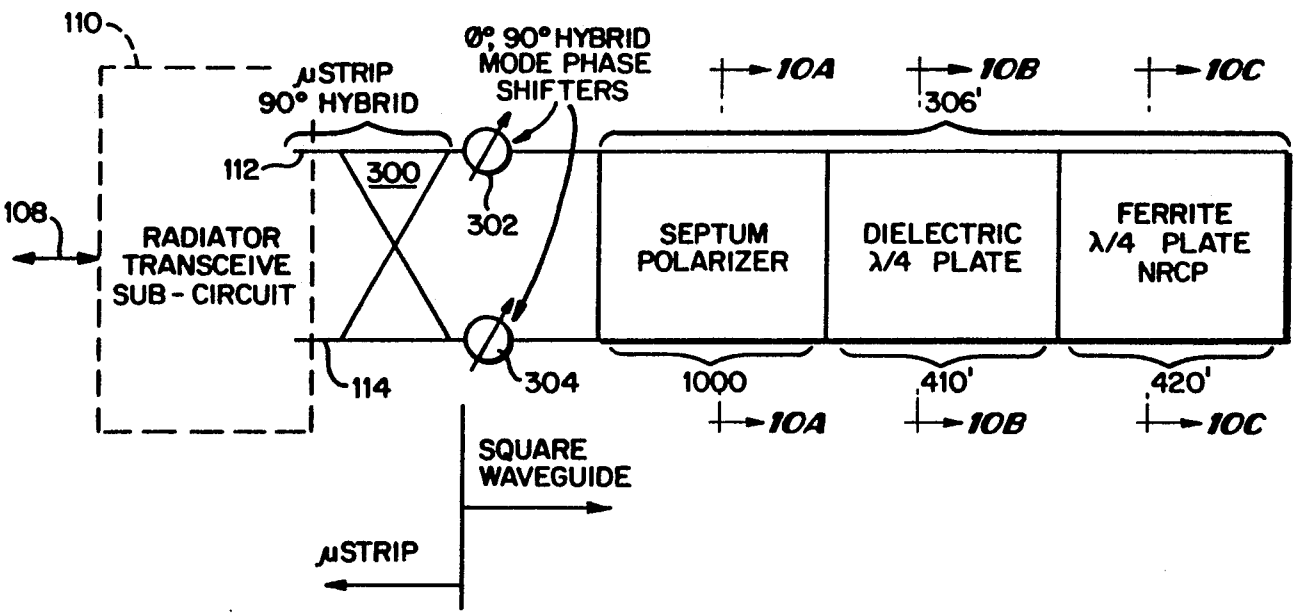
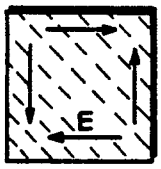
FIG. 10C
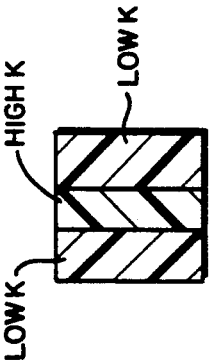
FIG. 10B
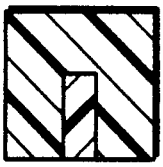
FIG. 10A

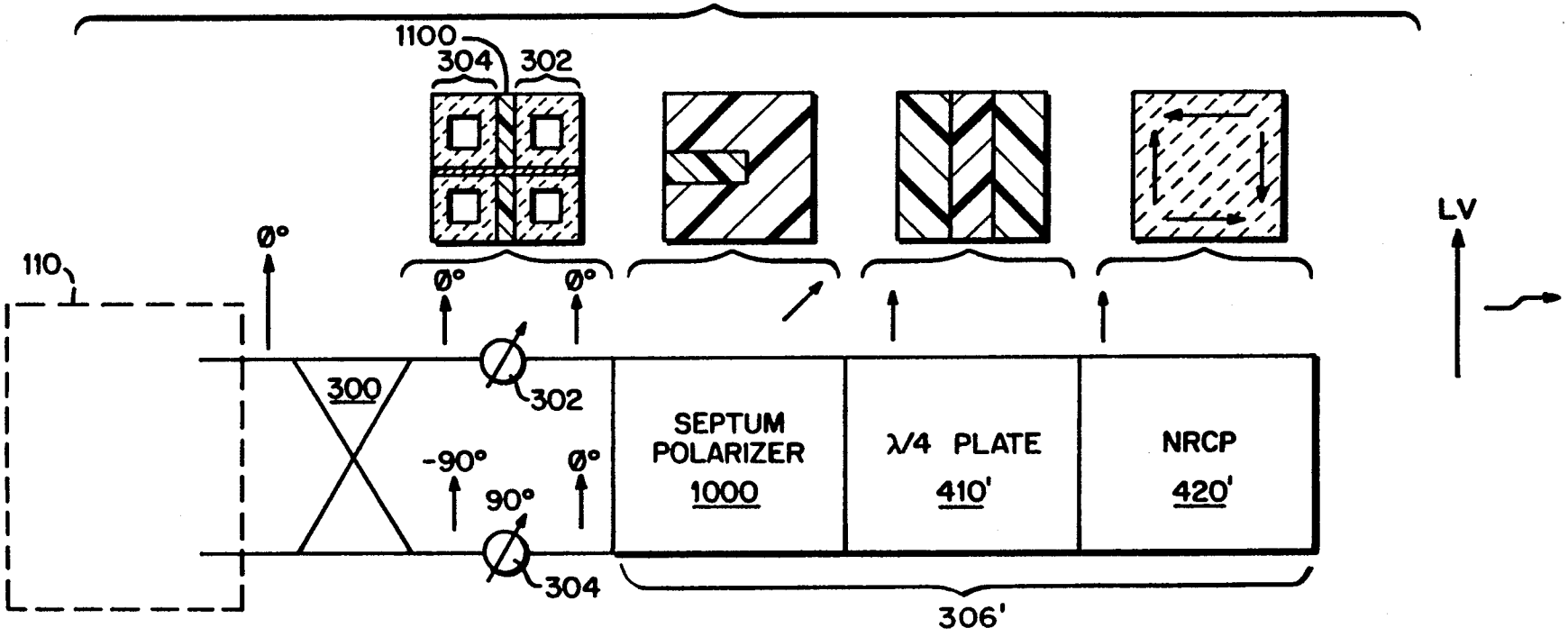
FIG. 11A TRANSMIT MODE

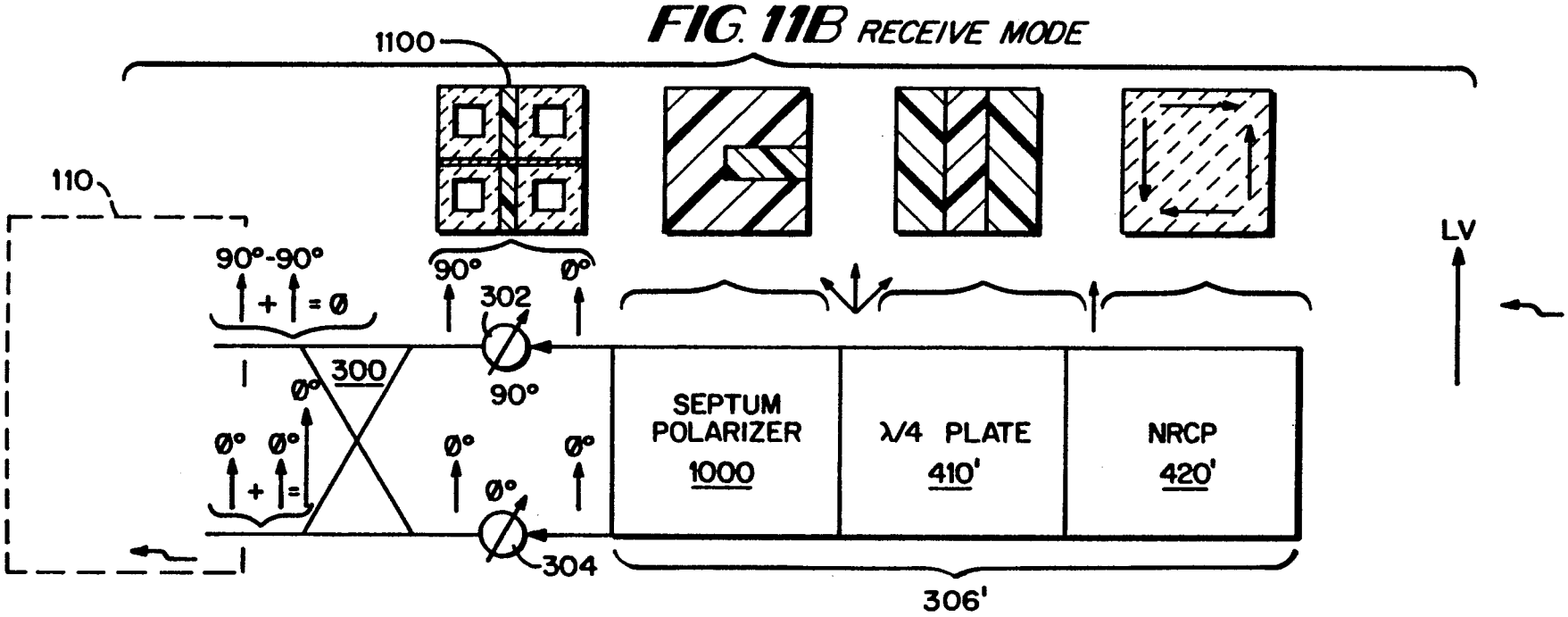
FIG. 11B RECEIVE MODE

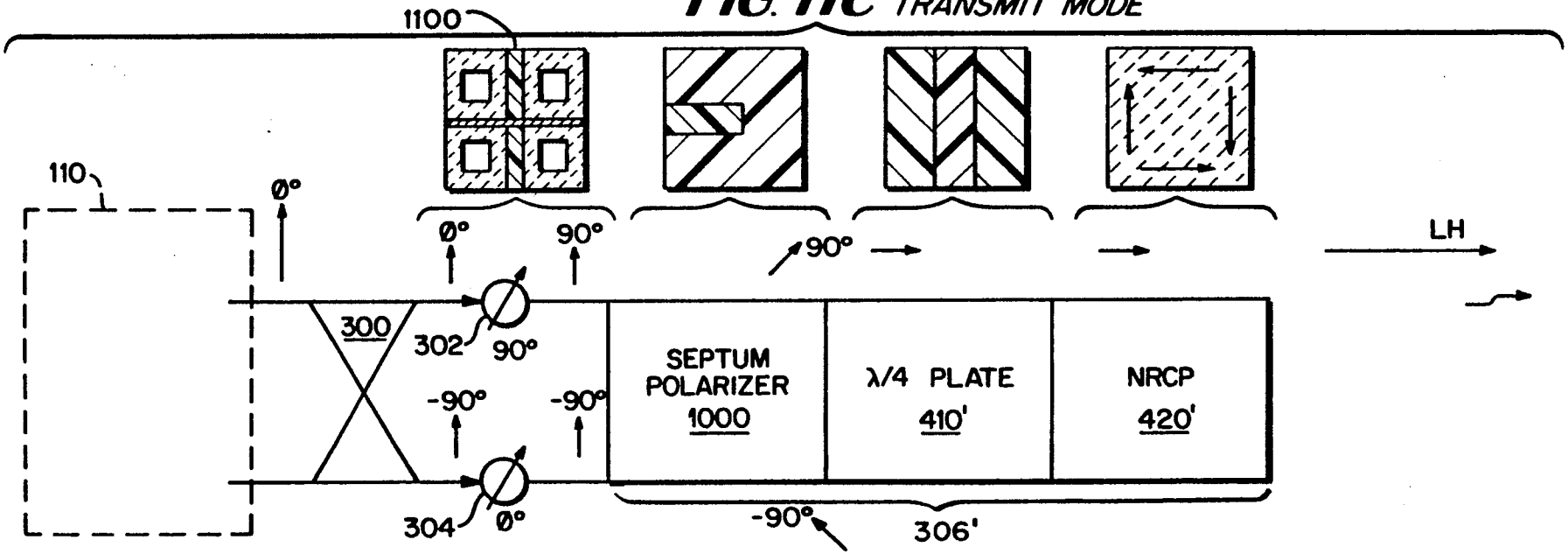
FIG. 11C TRANSMIT MODE

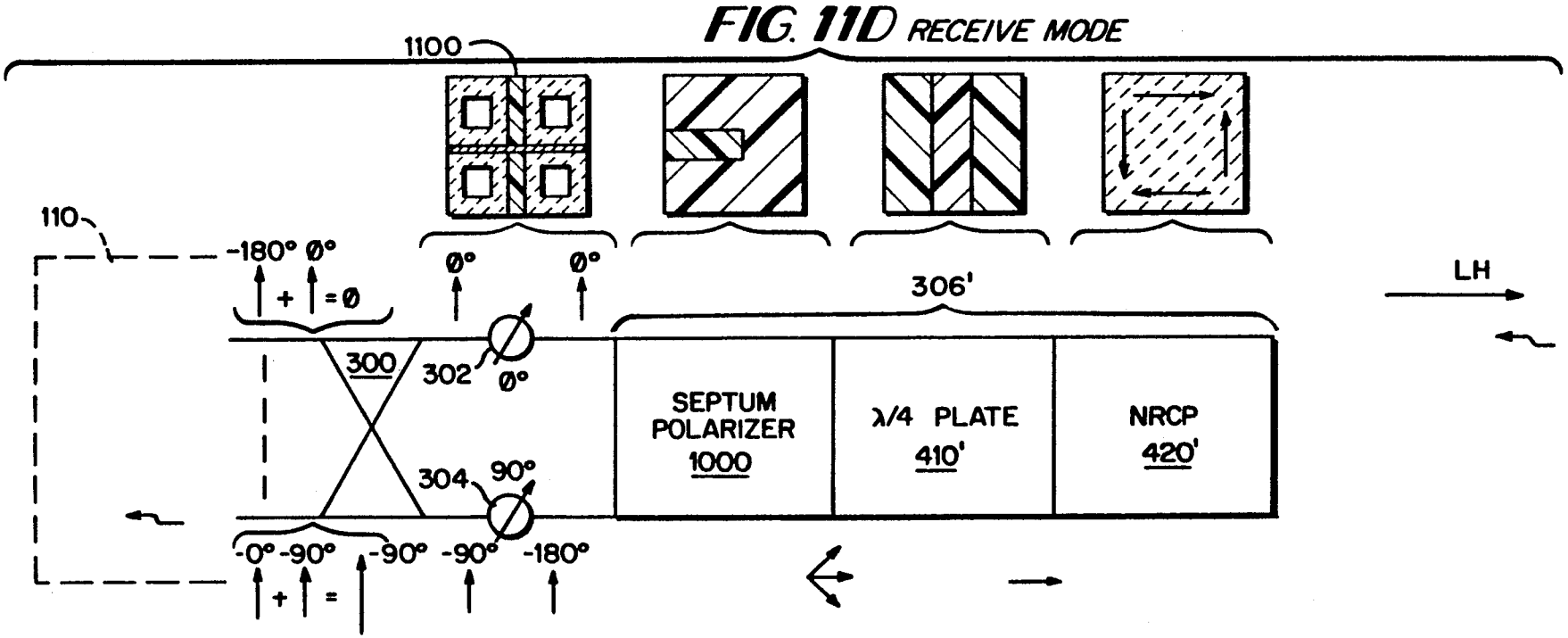
FIG. 11D RECEIVE MODE

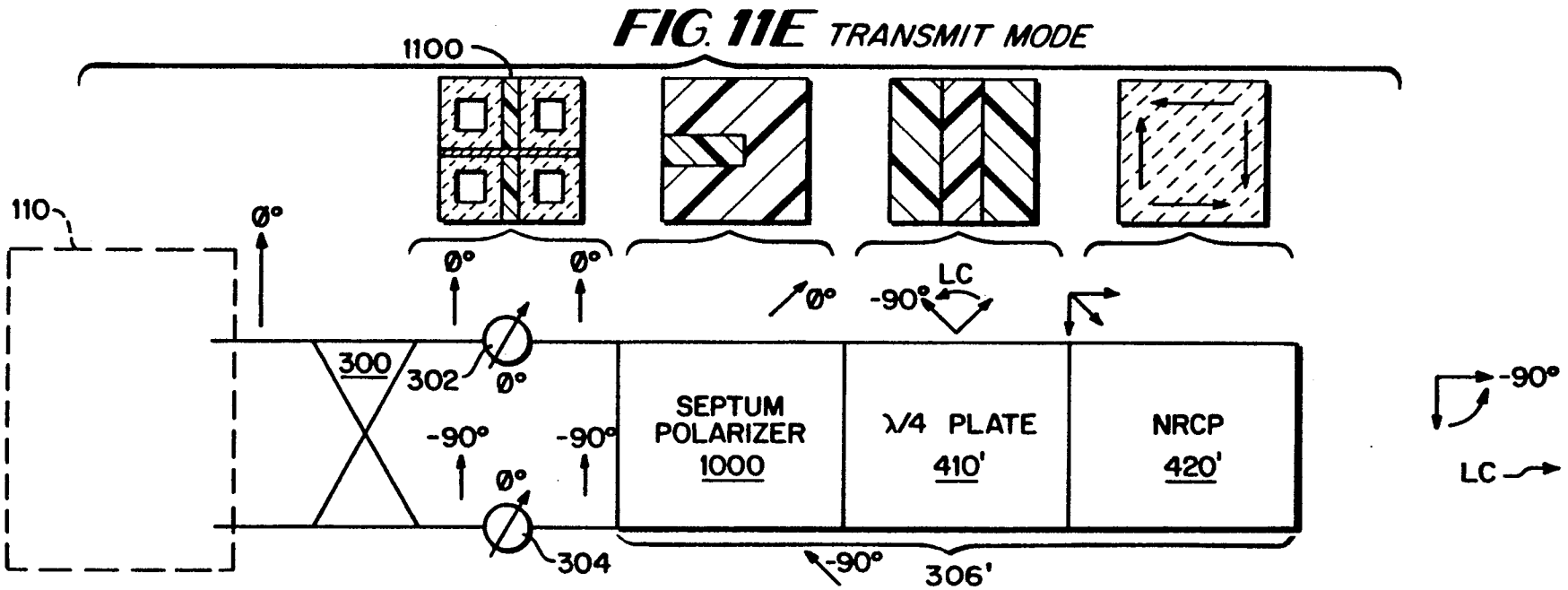
FIG. 11E TRANSMIT MODE

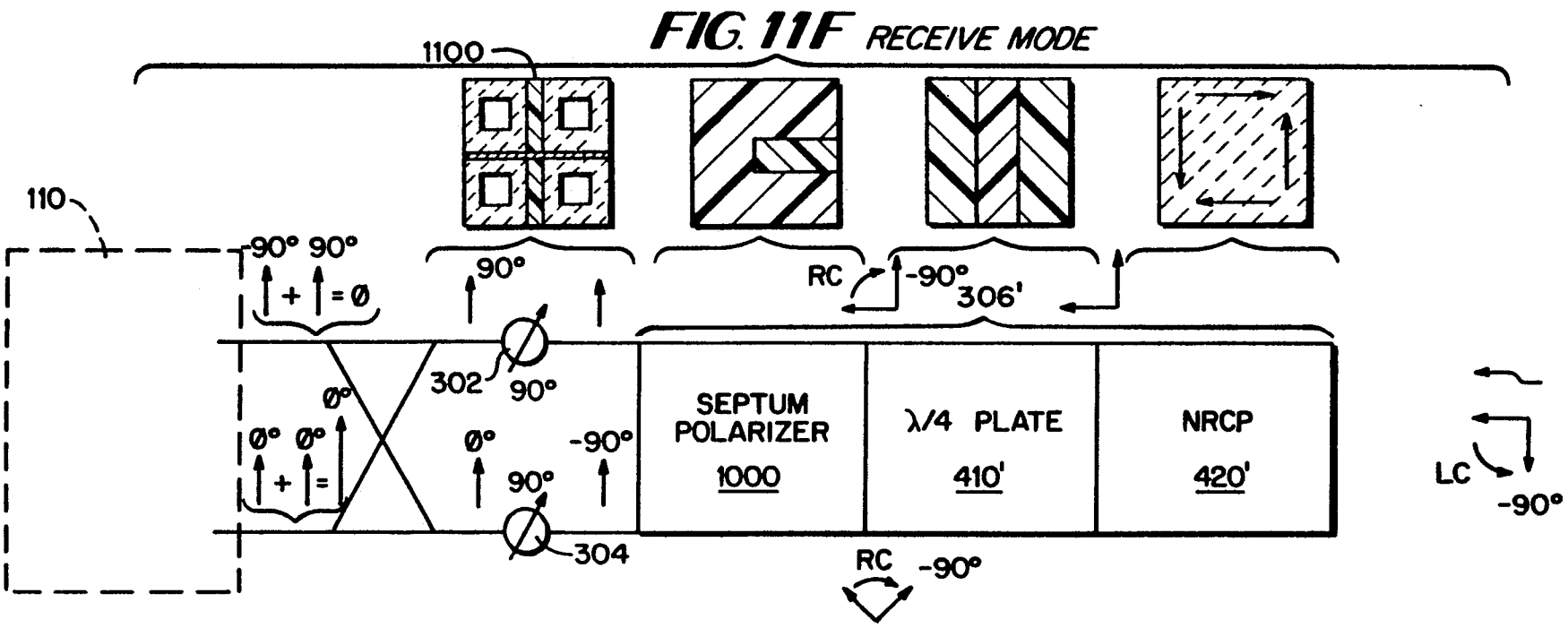
FIG. 11F RECEIVE MODE

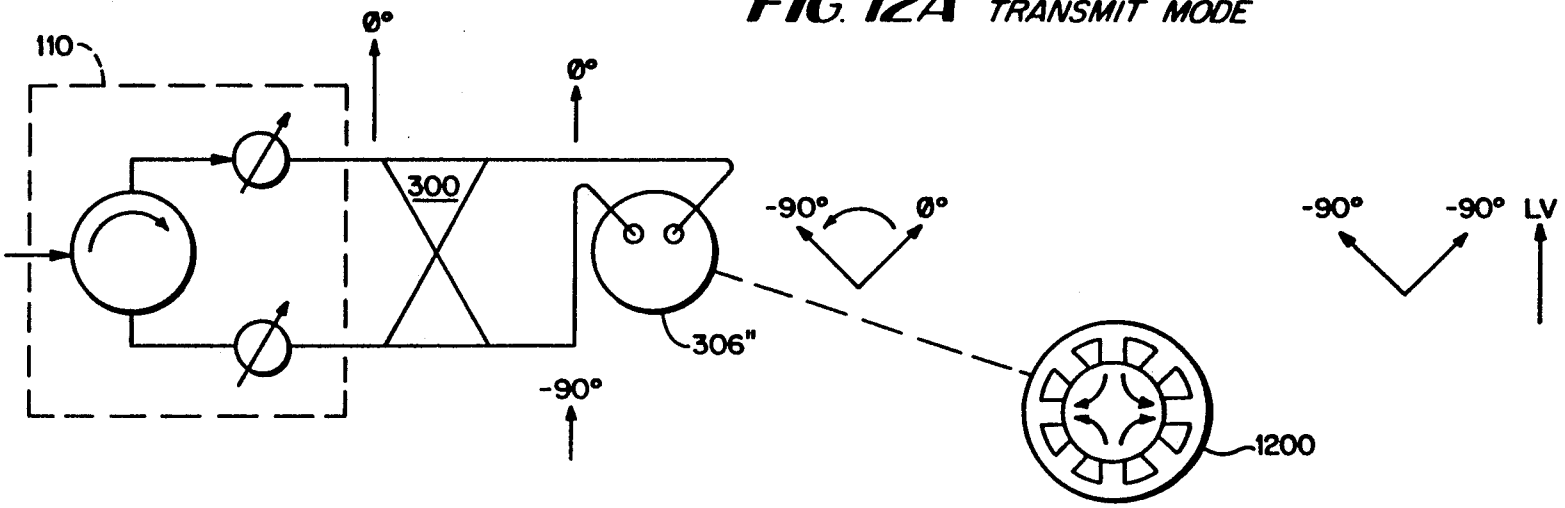
FIG. 12A TRANSMIT MODE
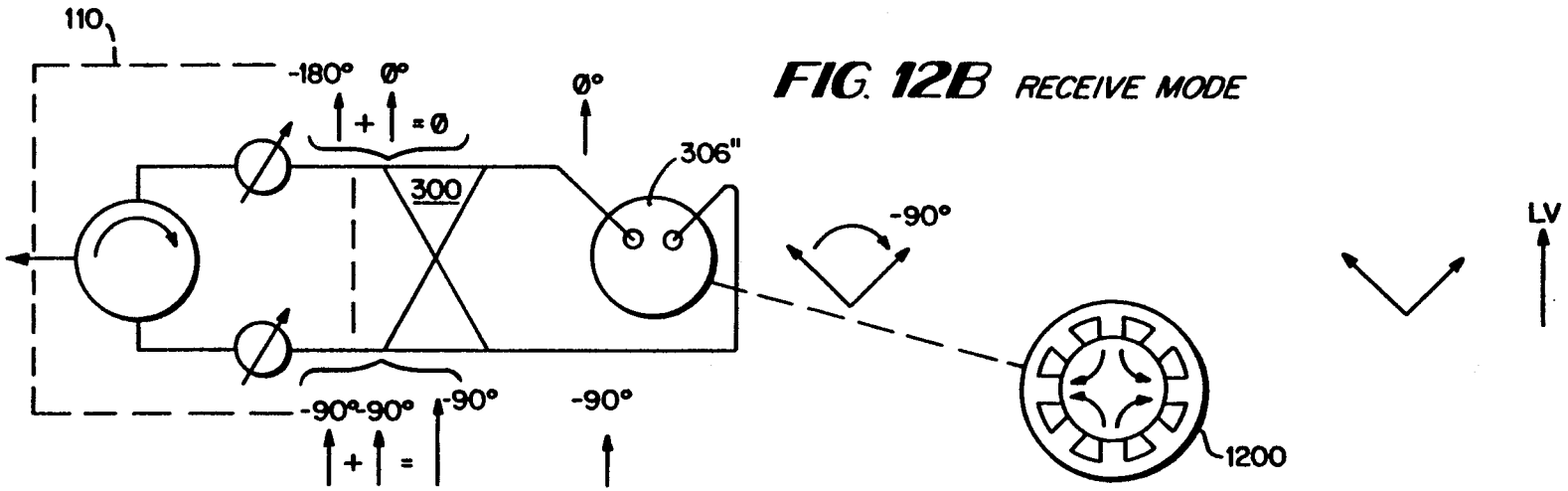
FIG. 12B RECEIVE MODE

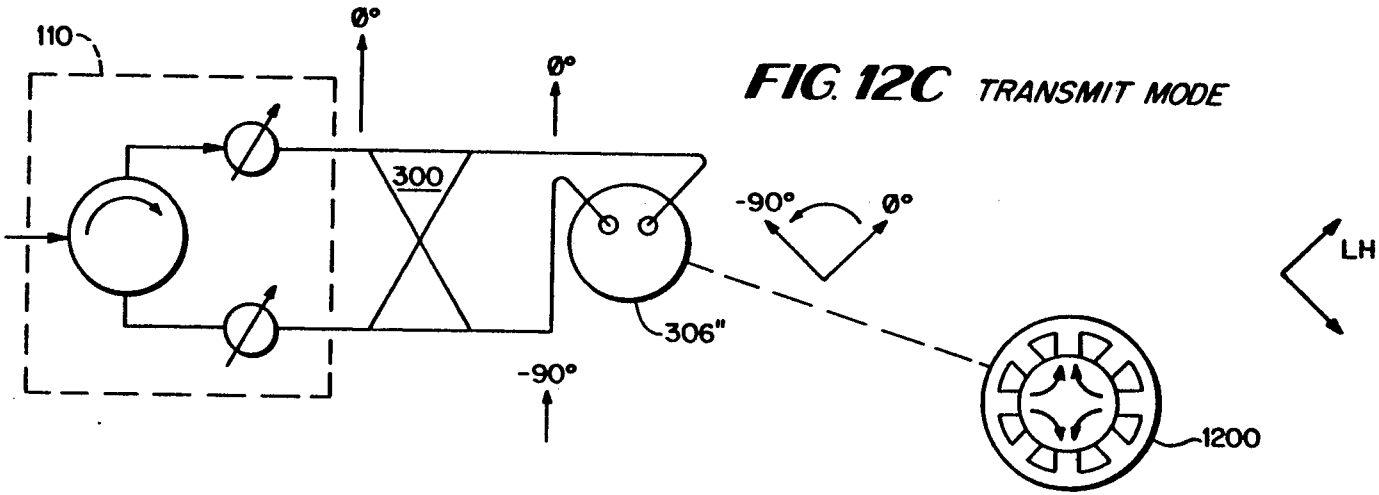
FIG. 12C TRANSMIT MODE
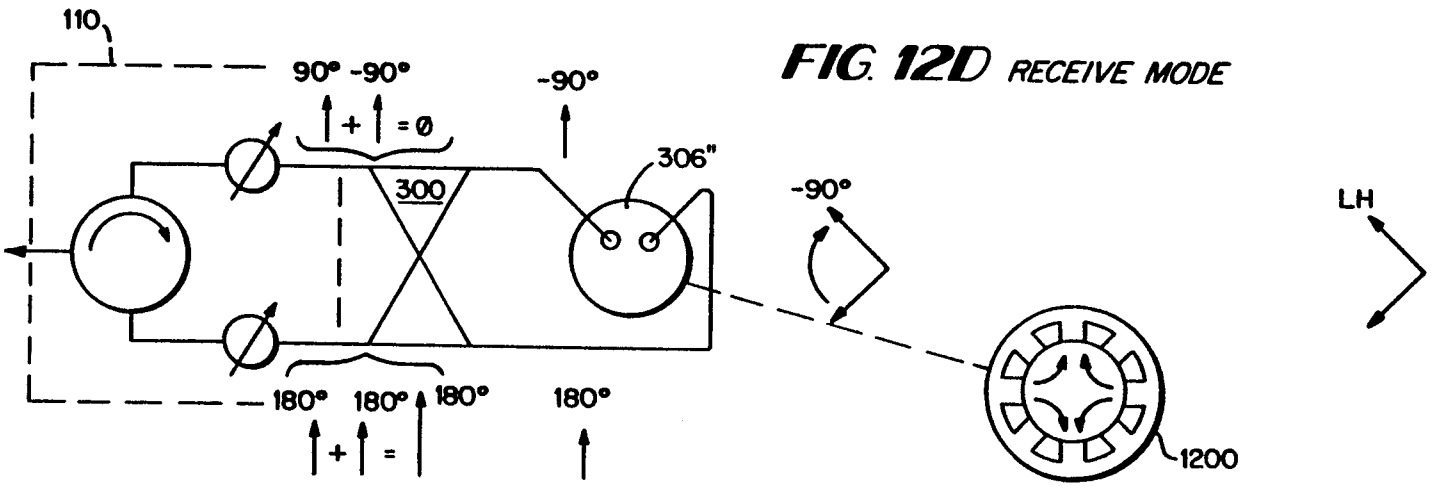
FIG. 12D RECEIVE MODE

POLARIZATION AGILITY IN AN RF RADIATOR MODULE FOR USE IN A PHASED ARRAY

BACKGROUND OF THE INVENTION

Field of the Invention

This invention relates generally to RF radiator modules for use in a phased array. More particularly, this invention provides polarization agility for such modules in advantageous spatially compact, economical and relatively easily implemented embodiments.

Related Patents and Patent Applications

This application is related to the following commonly assigned U.S. patents and patent applications:

- U.S. Pat. No. 4,445,098—Sharon et al (1984)
- U.S. Pat. No. 4,884,045—Alverson et al (1989)
- U.S. Pat. No. 5,128,099 issued Jul. 7, 1992 naming Roger G. Roberts as inventor and entitled "Reciprocal Hybrid Mode RF Circuit for Coupling RF Transmission to an RF Radiator;"
- U.S. Pat. No. 5,075,648 issued Dec. 24, 1991 naming Roger G. Roberts et al as inventors and entitled "Hybrid Mode RF Phase Shifter and Variable Power Divider Using the Same" (now U.S. Pat. No. 5,075,648);
- U.S. Pat. No. 5,089,716 issued Feb. 18, 1992 naming David W. Wallis et al as inventors and entitled "Simplified Driver For Controlled Flux Ferrite 525 Phase Shifter" now U.S. Pat. No. 5,089,716;
- U.S. Pat. No. 5,170,138, issued Dec. 1, 1992 a continuation-in-part of U.S. Pat. No. 5,075,648, naming Roger G. Roberts et al as inventors and entitled "Single Toroid Hybrid Mode RF Phase Shifter."

The entire contents of all the above-listed patents and patent applications are hereby incorporated by reference.

Brief Description of the Prior Art

Phased arrays of RF radiators are by now well-known in the art. In general, such arrays may comprise a two-dimensional array of $N_1 \times N_2$ RF radiators (where $N_1$ is the number of rows and $N_2$ is the number of columns in the array), each capable of transmitting-/receiving RF electromagnetic signals propagated through space. By judiciously spacing and locating each individual radiator in the array and by carefully controlling the relative phasing of RF electrical signals being fed to and from each of the radiators over the entire array aperture, an array "phase gradient" can be defined. By also carefully controlling the relative amplitude or attenuation of RF electrical signals being fed to and from each radiator over the entire array aperture an "amplitude taper" also may be defined. One may quite precisely define the overall radiation pattern configuration and orientation by properly controlling the relative phase and amplitude of each radiator module. The amplitude taper is usually designed into the feeding network and a variable phase gradient is obtained by RF phase shifters. For example, by appropriately controlling (i.e., changing) the phase settings of radiators in such an array, a well-defined beam radiation pattern may be electronically pointed over a major portion of a hemisphere without any mechanical movement of the array or any of the arrayed radiator elements.

Such phased arrays may be utilized, for example, in airborne, ground-based, space platform based, etc. locations. One application may be a radar system where a radar RF transmitter/receiver system uses the entire phased array as a common RF transmit/receive transducer with a relatively narrow "pencil beam" radiation pattern that can be shaped and pointed electronically as desired by appropriate and timely computer control of the relative phases (and, if desired, amplitudes) of RF signals being transmitted/received at each individual radiator site.

Conventional duplex RF radiator modules for use in a phased array may be of many different types. However, two currently typical types are depicted in FIGS. 1 and 2. FIG. 1 schematically depicts a reciprocal hybrid mode element (RHYME) circuit of the type-described in more detail at related U.S. Pat. No. 5,129,099 referenced above. It employs standard microstrip circulators 100 and 102 together with a pair of hybrid mode non-reciprocal latchable phase shifters 104 and 106 (e.g., of the type described more fully in related U.S. Pat. No. 5,075,648 cited above). Thus, a transmit/-receive duplex port 108 in the microstrip mode provides input to a duplex radiator sub-module 110 comprising circulator 100 and latchable phase shifters 104, 106. This provides separate transmit and receive microstrip RF lines 112, 114 which, in conjunction with a conventional microstrip output circulator 102, communicate RF signals to/from a conventional RF radiator 116 (e.g., a waveguide radiator with a loop coupler connected to the microstrip output of circulator 102). As will be appreciated by those in the art, appropriate phase shifts are conventionally determined by an array controller computer (not shown) and then used to latch phase shifters 104, 106 at desired relative phase shifts for transmitting and receiving purposes in connection with each particular radiator 116. Similar phasing (and possibly amplitude control as well) is determined and latched into radiator transceive circuits 110 for all of the $N_1 \times N_2$ radiators 116 of the array so as to define the appropriate radiation pattern shape, pointing angle, etc. This circuit will allow the same or different phases on transmit and receive without switching between transmit and receive.

FIG. 2 depicts a typical hybrid microwave integrated circuit (MIC) or monolithic microwave integrated circuit (MMIC) which provides implementation for the radiator transceive circuit 110. Such MIC or MMIC circuits are typically implemented on gallium arsenide substrates. They typically include a controllable integrated phase shifter 120, a controllable integrated attenuator 122, a controllable integrated transmit/receive switch 124, a relatively high power integrated amplifier 126 on the transmit leg of the MMIC with an integrated transmit/receive limiter 128 and integrated low noise amplifier 130 in the receive leg of the MMIC. The MMIC is typically mounted on a printed circuit board with microstrip mode input and output connections. Otherwise, the overall operation of the MMIC in FIG. 2 (together with the usual circulator 102 and radiator 116) is similar to that of the RHYME circuit depicted and already described with respect to FIG. 1.

Increasingly, it is desirable to permit controlled change in the spatial polarization of electromagnetic RF signals transmitted/received to/from radiators 116 of a phased array. For example, good radar performance during bad weather conditions may require the radar to transmit in a first sense circular polarization (e.g., left-hand circular polarization) and to receive the same sense circular polarization (e.g., left-hand circular polarization). Rain clutter signals will return with an opposite sense circular polarization (e.g., right-hand circular polarization) and therefore be rejected. On the other hand, radar return from man-made clutter may tend to be stronger for linear vertical or linear horizontal polarizations of electromagnetic signals. As those in the art will appreciate, there are numerous potential advantages to be had if one could quickly, efficiently and economically switch an entire phased array from operation in one polarization mode to operation in another different polarization mode. In particular, it is desirable, if possible, for a phased array to be capable of switching quickly and efficiently to any one of several different polarizations (e.g., linear vertical, linear horizontal, right-hand circular, left-hand circular). Most desirably, such switchable control between different polarization modes for the array would be accomplished at the level of the individual radiating elements so that major feed and phase latching elements necessarily used to control the overall phased array may continue to conventionally operate using only one polarization or mode.

Typical prior art approaches for achieving polarization switching at a radiator element level involve the use of switchable ferrite quarter wave plates or 45° Faraday rotators in conjunction with a reciprocal quarter wave plate. These devices are typically quite slow in switching speed (e.g., typical switching times are on the order of 100 microseconds or so). Further details of such prior art approaches can be had by reference to U.S. Pat. No. 3,698,008—Roberts et al, issued Oct. 10, 1972 entitled "Latchable, Polarization-Agile Reciprocal Phase Shifter."

BRIEF SUMMARY OF THE INVENTION

We have now discovered that a 90° microstrip coupling circuit (for example a Lange coupler) cascaded with a pair of non-reciprocal latchable phase shifters (e.g., capable of being latched to alternative relative phase shifts of 0° or 90° ) may be used in conjunction with a dual orthogonal radiator to achieve more economic and rapid polarization agility (e.g., in conjunction with a RHYME circuit or an MMIC or other similar radiator transceive circuits). This circuit also accomplishes the duplexing (i.e., replaces the duplexing circulator).

In one exemplary embodiment, the RF radiator structure included with the module includes two orthogonal conductive coupling loops at one end of a circular waveguide. These loops are respectively coupled to microstrip outputs of latchable 0°, 90° phase shifters followed by a reciprocal dielectric quarter-wave plate and a non-reciprocal fixed ferrite quarter-wave plate (leading to the exit end of the circular waveguide). Although the coupling loops may be disposed in an air or other gas-filled (or vacuum) section of the circular waveguide, they are preferably potted with a solid dielectric material so that the entire RF radiator structure becomes a substantially solid monolithic cylinder that can thereafter be coated with an electrical conductor to define the conductive circular waveguide. Of course the usual permanent magnets would also be arrayed circumferentially about the non-reciprocal fixed ferrite quarter-wave plate portion of waveguide as will be appreciated by those in the art. This circuit will accept a microstrip input and switch to linear vertical, linear horizontal or one sense circular at the output. The same polarization will be received as transmitted with duplexing, no switching being required between transmit and receive.

Preferably, a 90° Lange hybrid microstrip circuit as well as a pair of hybrid mode 0°, 90° phase shifters are disposed on a common printed circuit board which is physically attached to the non-radiating end of the waveguide radiator. Suitable latch wire driving circuitry for the 0°, 90° phase shifters (as well as the usual more versatile controllable phase shifters associated with each radiating module) may conveniently be disposed on the opposite side of the same printed circuit board to form a composite compact structure having an overall maximum diameter on the order of 0.6 wavelengths or less so that it may conveniently fit within the usual inter-radiator element spacing of a typical phased array.

For use with the usual RHYME or MMIC radiator transceive sub-module circuits, the cascaded 90° Lange hybrid microstrip circuit and a pair of 0°, 90° latchable phase shifters may be effectively substituted for the usual microstrip circulator used to couple the sub-module transmit and receive RF lines to the radiator structure within each RF radiator module.

There are a number of latch wire arrangements which could be used to latch the dual toroids. A more conventional approach would be to drive each individual phase shifter separately and each phase shifter can be switched to its 0° or 90° state independently of the other.

A particularly compact latch wire arrangement for the two 0°, 90° latchable phase shifters permits one of three predefined dual phase shifter states. The 0° state is defined as that state in which the phase shifter is latched to its electrically long state and therefore the 90° state is defined as that state in which the phase shifter is latched to its electrically short state. The length of the phase shifters is set so that the two states are 90° apart. The three predefined states of the phase shifters in the switch are 0°, 0°; 0°, 90°; and 90° 0°, to be easily actuated via a single latch wire. These states are usually actuated via one of the three latch wires. For example, a pair of latching phase shifters may be latched in a 0°,0° state by one latch wire, and a 0°, 90° state by another latch wire and in a 90°, 0° state by yet a third latch wire.

When this polarization switching technique is used, the same polarization as transmitted will be received in the receive path and the orthogonal polarization will be received in the transmit path. As will be appreciated, this may have special advantages for the RHYME or MMIC TR module. For example, if the input circulator of the RHYME is a four port circulator, the orthogonal polarization would be available at the fourth port. The transmit phase shifter would have to switch between transmit and receive to receive the orthogonal polarization looking in the same scan direction.

If desired, the waveguide portion of the pair of hybrid mode phase shifters may be stacked on opposite sides of a common ground plane and used to directly feed a waveguide radiator (i.e., thereby obviating the microstrip mode at this end of the phase shifters) comprising, in series, a dielectric septum polarizer, a reciprocal dielectric quarter-wave plate and a non-reciprocal ferrite quarter-wave plate. This avoids transitions to microstrip and back to waveguide modes, the use of coupling loops in the non-radiating end of the waveguide radiator, etc. In this embodiment, the waveguide radiator is preferably of square cross-section.

The use of a 90° Lange hybrid microstrip circuit even without extra 0°, 90° phase shifters but, instead, in conjunction with an electrically rotatable ferrite quarter-wave plate radiating element may also achieve polarization agility with respect to at least linear polarizations of transmitted/received electromagnetic radiation.

BRIEF DESCRIPTION OF THE DRAWINGS

These as well as other objects and advantages of this invention will be more completely understood and appreciated by careful study of the following detailed description of several exemplary embodiments of this invention when taken in conjunction with the accompanying drawings, of which:

FIG. 1 is a schematic diagram of a typical prior art reciprocal hybrid mode element (RHYME) circuit for one radiator element of a phased array;

FIG. 2 is a schematic depiction of a typical prior art monolithic microwave integrated circuit (MMIC) radiator transceive circuit also to be utilized for a single radiator element of a phased array;

FIG. 3 is a schematic depiction of a 90° Lange hybrid microstrip coupling circuit cascaded with a pair of 0°,90° latchable phase shifters and a suitable radiator transceive sub-circuit interfaced with a dual mode orthogonal radiator in accordance with a first exemplary embodiment of this invention;

FIGS. 5A, 5B, 5C and 5D are top, side, perspective and schematic end views respectively of a polarization agile duplex RF radiator module for use in a phased array in accordance with this invention utilizing the radiator of FIG. 4, a RHYME radiator transceive sub-circuit (from FIG. 1) in the exemplary embodiment depicted at FIG. 3;

FIGS. 6A, 6B, 6C and 6D are schematic depictions of the FIG. 3 embodiment using an MMIC transceive sub-circuits in transmit and receive modes for both (i) linear vertical and (ii) linear horizontal polarization modes respectively;

FIGS. 7A, 7B, 7C, 7D, 7E and 7F schematically depict the FIG. 3 embodiment using a RHYME and illustrating both transmit and receive modes for (i) linear vertical, (ii) linear horizontal and right-hand circularly polarized polarization;

FIG. 10 generally depicts yet another embodiment of this invention wherein a square waveguide radiator structure is directly coupled to the waveguide portions of a pair of 0°, 90° hybrid mode phase shifters;

FIGS. 10A, 10B and 10C are cross sectional depictions at various points in the square waveguide structure of FIG. 10;

FIGS. 11A, 11B, 11C, 11D, 11E and 11F are schematic depictions of the FIG. 10 embodiment set up for both transmit and receive modes in (i) linear vertical, (ii) linear horizontal and (iii) left-hand circularly polarized modes of operation;

FIGS. 12A, 12B, 12C and 12D schematically depict both transmit and receive modes (i) for linear vertical and (ii) linear horizontal operation of the FIG. 12 embodiment.

These drawings include reference numerals that link the drawings to the following detailed written description. For consistency, like components in the various figures are marked with the same reference numeral. For brevity, the description of these like components is not repeated for each figure.

DETAILED DESCRIPTION OF EXEMPLARY EMBODIMENTS

Figure 3A:
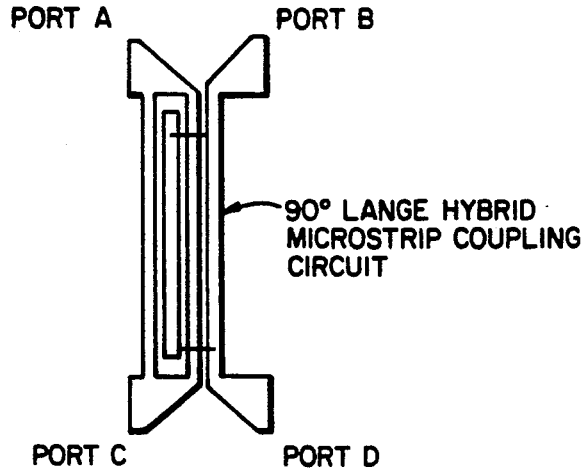
FIG. 3A (PRIOR ART)
FIG. 3A is a schematic depiction of a typical 90° Lange hybrid microstrip coupling circuit.

In the exemplary embodiment of FIG. 3, a conventional radiator transceive sub-circuit 110 (e.g., like those depicted in FIGS. 1 and 2) is employed. However, instead of a prior art output microstrip circulator 102 coupling transmit/receive RF lines 112, 114 to the radiator, a 90° Lange hybrid microstrip coupling circuit 300 is employed in cascade with a pair of non-reciprocal latchable hybrid mode phase shifters 302 and 304 to couple the radiator transceive sub-circuit 110 to a dual mode orthogonal radiator 306.

In the exemplary embodiment of FIG. 3, the usual output circulator 102 has been effectively replaced with a 90° hybrid microstrip circuit and two 90° non-reciprocal latching hybrid mode phase shifters. An additional coupling loop for the other polarization of radiation is also added to a typical circular waveguide radiating element 306.

The 90° Lange hybrid microstrip coupling circuit may be of the usual conventional type depicted at FIG. 3A. Here, for example, if a input RF signal of 0° phase is assumed to be input at port A, then reduced amplitude (−3 dB) RF signals will be output at ports B and C with relative phase shifts of 0° and −90° respectively. Substantially zero RF power will be output from port D (i.e., it is "isolated"). As is recognized by those in the art, the same sort of relative signal distribution will occur from the various input/output ports of such a coupling circuit when similar input signals are inserted at other of the ports. For example, if a unit magnitude 0° relative phase RF signal is input at port D, then reduced amplitude (−3 dB) signals will be output from ports C and B with relative phases of 0° and −90° respectively (there being essentially zero output from port A as a result of inputs to port D). Similar suitable 90° coupling circuits may also be known to those in the art.

The non-reciprocal latchable hybrid mode phase shifters 302, 304 are, in this exemplary embodiment, preferably of the type disclosed more fully in related U.S. Pat. No. 5,075,648. However, they may be of relatively simple design so as to be capable of latching to produce relative phase shifts of only 0° or 90° in this exemplary embodiment. Such hybrid mode phase shifters include microstrip mode input and output circuits with a waveguide mode disposed in between. The waveguide mode includes a double toroid ferrite structure with suitable latch wires threaded therethrough so as to set the ferrite cores to desired states of remnant magnetization—and thus to produce desired 0° or 90° relative phase shifts as RF signals traverse through the phase shifter structure. As will be appreciated, if the non-reciprocal phase shifter can only be switched between 0° and 90° states, then it will automatically be set in the alternate phase state for signals passing in the reverse direction. That is, if a 0° phase shift is inserted in the forward or transmit direction, then without any need to reset its remnant flux, the phase shifter will produce a 90° phase shift for signals propagating in the reverse or receive direction. As will be appreciated later, for many of the exemplary embodiments this permits transceive operations for a selected polarization state without the need to switch the phase shifter(s) between transmit and receive operations.

In the exemplary embodiment of FIG. 3, the microstrip outputs from phase shifters 302, 304 are connected to orthogonal current loops 308, 310 respectively in a dual mode orthogonal radiator 306 which may be a circular waveguide (i.e., the current loops 308, 310 excite appropriate orthogonal modes within the circular waveguide). An exemplary dual mode orthogonal circular waveguide radiator 306 is shown in more detail at FIG. 4. Here, a first section 400 contains conventional coupling loops 308, 310. As can be seen, each coupling loop conductor has a leg extending through a respective insulated aperture 402, 404 then proceeding in an inverted U-shaped locus to terminate at the opposite leg end by a connection to RF ground at 406, 408 respectively, (i.e., at the non-radiating end of waveguide 306). Each coupling loop 308, 310 has a total length of approximately one-half wavelength in the ambient medium surrounding such loops. Although the loops could be contained in vacuum, air, or other gases, in the exemplary embodiment they are preferably potted in a suitable solid dielectric (e.g., with a relative dielectric constant of approximately 6) which is finished to a cylindrical outer shape.

Outwardly from section 400, exemplary waveguide 306 next includes a conventional, reciprocal dielectric quarter-wave plate 410. As shown in the cross-sectional depiction at FIG. 4A, the reciprocal dielectric quarter-wave plate includes a center slab 412 of relatively high dielectric constant (e.g., relative dielectric constant of about 16) while the dielectric 414 and 416 to either side of the central slab 412 are made from a relatively lower dielectric constant material (e.g., relative dielectric constant of about 9). The higher dielectric constant slab 412 may be made, for example, from a magnesium titanate material while the outer sections 414, 416 may be made from an alumina material. The different materials may be epoxied together and glued in place adjacent section 400 of waveguide 306.

Finally, the outer section 420 of waveguide 306 is a conventional non-reciprocal fixed ferrite quarter-wave plate. As shown in the cross sectional depiction in FIG. 4B, a cylindrical ferrite (e.g., a lithium ferrite for the X-band frequencies) 422 is surrounded by four magnets 424, 426, 428 and 430 poled as shown so as to produce magnetic fields 432 within the ferrite core 422 (as is conventionally known so as to produce the desired non-reciprocal fixed ferrite quarter wave plate structure). As will be appreciated by those in the art, the quarter-wave plates 410 and 420 may be approximately 0.25 or 0.3 inches in length which approximates about one wavelength at X-band frequencies in these media.

Figure 4:
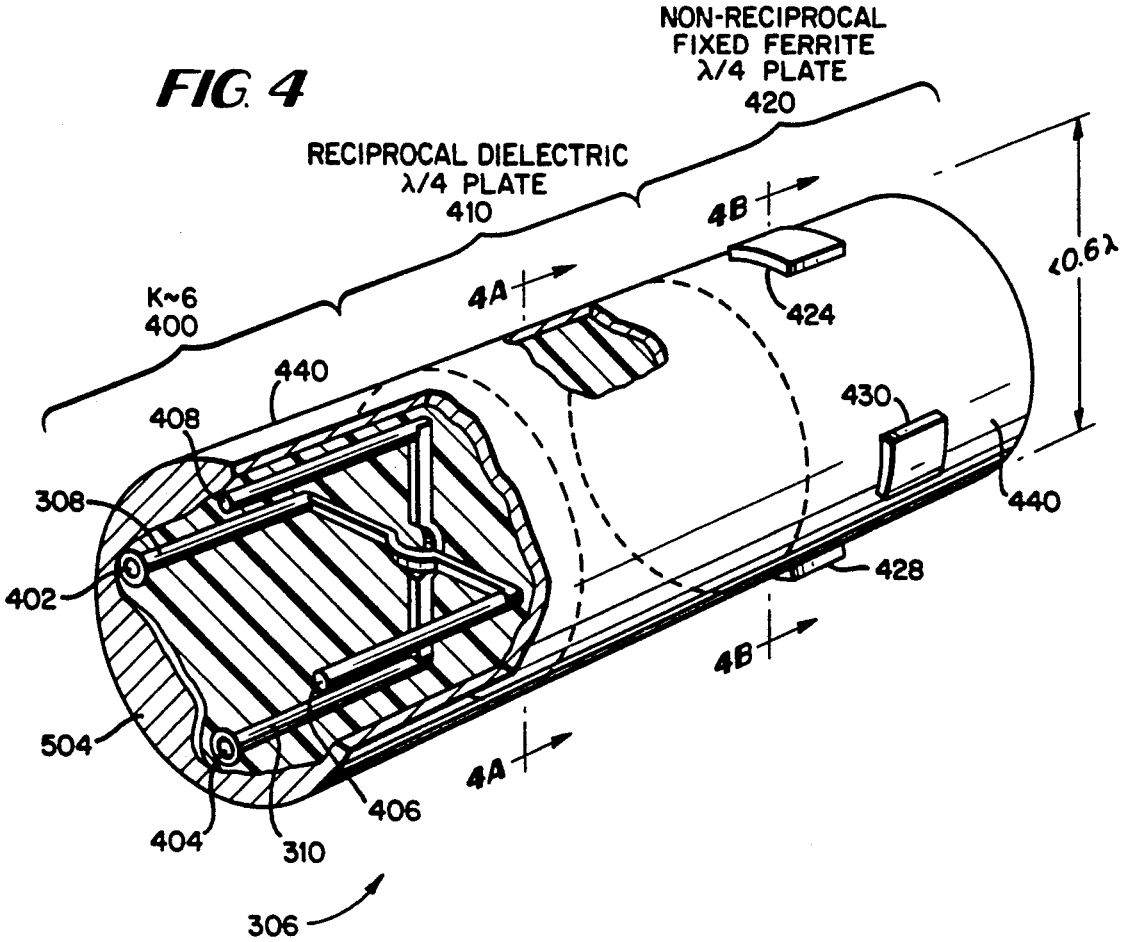
FIG. 4 is a schematic perspective view of a dual mode orthogonal circular waveguide radiator which may be used with the FIG. 3 embodiment of this invention.
Figure 4A:
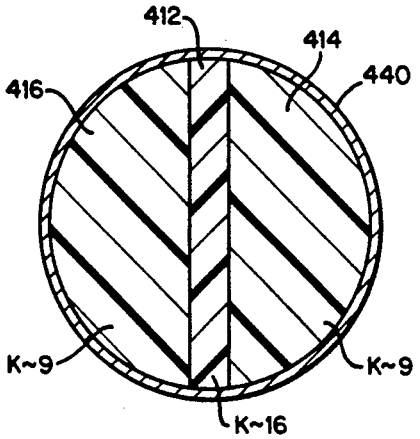
FIGS. 4A and 4B are cross-sectional depictions of the radiator depicted at FIG. 4.
Figure 4B:
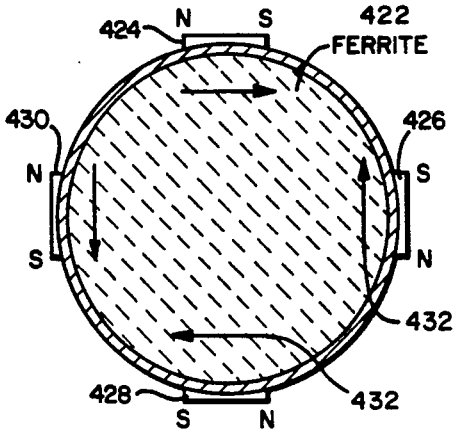

After the sections 400, 410 and 420 of the waveguide 306 are suitably glued together (e.g., with epoxy) and, if not already of cylindrical form, ground into a round configuration, then they are suitably plated with a conductor (e.g., copper plated with gold flashing) to form an outer circular waveguide conductive wall 440 along the entire cylindrical outer structure of waveguide 306. Since the design and functioning of such reciprocal dielectric quarter-wave plates and non-reciprocal fixed ferrite quarter-wave plates are well-known to those in the art, no further details are believed to be necessary. As will be appreciated, the RF radiation will actually emanate from the right-hand end of circular waveguide 306 as depicted at FIG. 4.

Figure 5A:
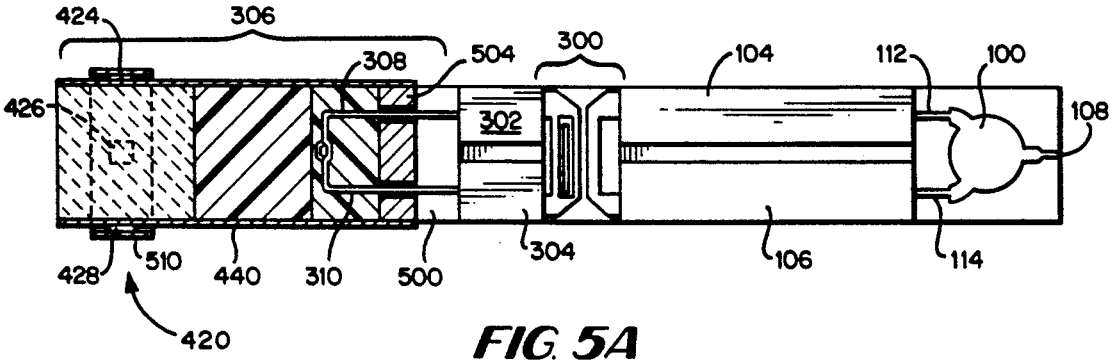

A schematic depiction of the physical appearance of the FIG. 3 embodiment (using a RHYME radiator transceive sub-circuit 110) is depicted at FIGS. 5A-5D. As shown in FIG. 5A, the usual module microstrip input/output port 108 is connected to one port of a microstrip circulator 100. The other two circulator ports are respectively connected to the microstrip inputs of hybrid mode phase shifters 104, 106. The microstrip ports at the other end of phase shifters 104, 106 are connected to respective input/output ports of the 90° Lange hybrid microstrip coupling circuit 300. The 90° hybrid microstrip circuit 300 is then connected in cascade with the pair of 0°,90° hybrid mode phase shifters 302, 304 which, in turn, feed coupling loops 308, 310 via their microstrip terminations.

Figure 5B:
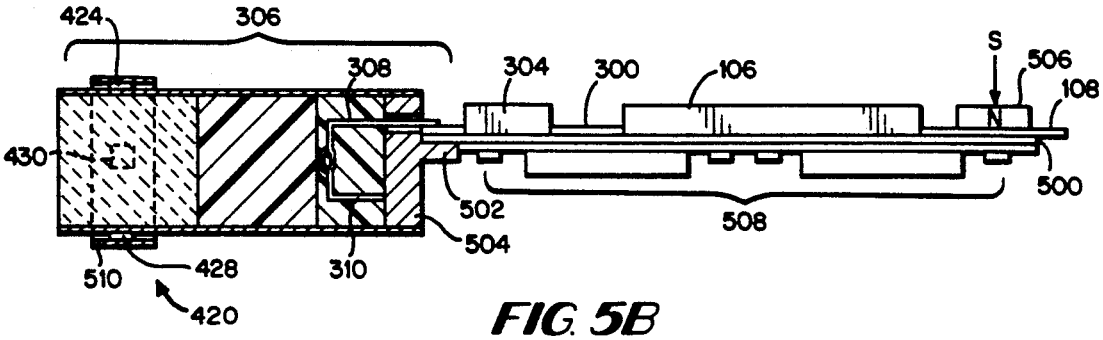

As can be seen in the side view of FIG. 5B, the elements just described (e.g., microstrip and/or hybrid mode phase shifters) are mounted on a common printed circuit board 500 which is supported by flange 502 of the conductive non-radiating end piece termination 504 of waveguide 306. The usual circulator magnet 506 can also be seen in FIG. 5B. The components 508 disposed on the underside of printed circuit board 500 may comprise the usual driving circuitry used to control the latch wires for hybrid mode phase shifters 104, 106 and 302, 304. Phase shifters 104 and 302 are not shown in FIG. 5B because they are hidden behind phase shifters 106 and 304, respectively, in the view presented in that figure. As will be appreciated by those in the art, such circuitry may include the usual data latches, power drivers, etc., required for accepting commanded phase changes from a central phase array controller computer bus. Such commands are then executed by applying pulses of suitable current through latch wires in ferrite toroids so as to produce the desired remnant magnetization flux and to thus achieve the desired phase shift. Controllable attenuators could of course also be controlled in similar fashion by the driving circuitry 508. As may be seen by the typical wavelength dimensions in FIGS. 5A-5D, the overall diameter of the entire RF radiator module is sufficiently small that the modules can be easily packed at the desired inter element spacing within the phased array (e.g., typically less than 0.6 wavelength from center to center).

As also depicted in FIGS. 5A-5D, the magnets 424, 426, 428 and 430 of the non-reciprocal fixed ferrite quarter wave plate 420 may be held in place by a suitable band 510.

The exemplary embodiment of FIGS. 6A–6D uses the MMIC of FIG. 2 as the radiator transceive sub-circuit 110. Here, the transmit mode is depicted at FIG. 6A. Hybrid mode phase shifters 302, 304 have been latched to the 0° and 90° phase shift states respectively. If it is assumed that a unit magnitude RF signal of 0° relative phase is present at transmit line 112 (as represented by the large vertical arrow with 0° nomenclature near its head), then the 90° hybrid microstrip coupling circuit 300 will provide reduced amplitude (−3 dB) outputs on the right-side of the circuit 300 (represented by small arrows) which is connected in cascade with the pair of phase shifters 302, 304. As indicated by nomenclature at the head of the reduced amplitude arrows at these ports in FIG. 6A, the relative phase of the input to phase shifter 302 is still 0° while the phase of signals input to phase shifter 304 is 90° . With the latchable phase shifters 302, 304 set as depicted in FIG. 6A, the RF signals actually presented to current loops 308, 310 (schematically represented as a bottom view of the loop legs going into insulated apertures in base 504 of waveguide 306) are 0° and 0° respectively. That is, the RF signals fed to the two orthogonal current loops are in phase. The spatially orthogonal current loops 308, 310 are represented by spatially orthogonal vectors 308', 310' depicted to the right of radiator 306 in FIG. 6A. As can be appreciated, the resultant vector sum 311' represents the actual linear vertical (LV) RF radiation transmitted from radiator 306. As will also be appreciated by those in the art, in the case of linear vertical (LV) and linear horizontal (LH) radiation, the reciprocal dielectric quarter wave plate 410 and the non-reciprocal fixed ferrite quarter-wave plate 420 may be omitted from the radiator 306 waveguide without charging the polarization of transmitted/received radiation.

FIG. 6B represents the same circuit configured for the receive mode. Here, incoming linear vertically (LV) polarized radiation 313' is intercepted by the waveguide radiator 306 and resolved by orthogonal current loops 308, 310 to two components each having relative phases of 0° as by the arrows and 0° depiction at the inputs of phase shifters 302, 304. The conventional reference point for observing the E-field vector polarization is to look toward the direction of propagation. Thus, for transmit modes, observation is away from the antenna and for receive modes observation is toward the antenna. To properly account for this convention, the left and right loop leg connections 308,310 are reversed for the receive modes when depicted in the FIGS. 6A and 6B.

As already explained, for the reverse or receive direction of propagation, phase shifters 302,304 are already in opposite phase states 90°,0° respectively. Thus, there is no need to switch flux remnant states in these phase shifters to permit reception in the same LV polarization mode. The input to the lower right-hand corner of the 90° hybrid microstrip coupling circuit 300 is still at 0° while the input at the upper right-hand corner of circuit 300 is now shifted −90°. As a result of these two inputs to the 90° hybrid microstrip coupler 300, the outputs at the upper left port will add destructively to zero while those at the lower left port will have a common relative phase of 0° and add constructively so as to provide a 0 dB input at 0° relative phase to the receive RF channel 114 of the radiator transceive sub-circuit 110.

FIGS. 6C and 6D show the same circuit configured respectively for transmit and receive modes but with phase shifters 302, 304 now set to produce linear horizontal (LH) modes of polarization. For example, at FIG. 6C, the transmit mode uses the 90°,0° phase states for phase shifters 302, 304. However, when one analyzes the circuit operation in the transmit mode, it will be appreciated from the vectors and relative phase angles depicted in FIG. 6C that the RF signals now supplied to coupling loops 308, 310 have relative phase angles of +90° and −90°. Accordingly, vector summation of the signals actually radiated will produce linear horizontal (LH) RF output 311'.

Similarly, FIG. 6D is automatically preset to the receive mode since phase shifters 302, 304 are already in the 0° and 90° phase shift states respectively for reverse or receive direction propagating signals. As should be apparent, received LH polarized radiation 313' is resolved into orthogonal components by coupling loops 308, 310. Once again, vector analysis as indicated in FIG. 6D shows signal progressions through phase shifters 302, 304 and the 90° Lange hybrid microstrip circuit 300. Duplexing operation is obtained by effective cancellation of signals at the upper left-hand port of circuit 300 and by constructive addition at the receive channel lower left-hand port of circuit 300 (now with a common +90° phase shift).

The circuitry of FIGS. 6A–6D can also be used to provide right circular (RC) and left circular (LC) polarizations if the 0°, 90° phase shifters 302, 304 are replaced with 0°, ±90° phase shifters. For transmitting RC polarization, the top phase shifter would be set to −90° and the bottom phase shifter would be set to 90°. These phase shifters would have to be switched for receiving RC polarization. For transmitting LC polarization, both phase shifters would be set to 0°. For receive, the top phase shifter would be set to −90° and the bottom to +90°. As will be appreciated, for these more complex embodiments, the phase shifters 302, 304 would preferably each be capable of effecting 0°,±90° phase shifts. Using 0°, ±90°, all 4 polarizations can be obtained by discrete bit switching, no flux drive is required. This can best be illustrated by considering the following Table I.

In the following table, the states for phasers 302,304 are provided in terms of relative phase shift and toroid magnetization states (on opposite sides of the center dielectric septum of the polarizers) for various polarizations with comments as to whether switching is required between transmit and receive:

TABLE I

| Phaser 302 | Phaser 304 | Polarization | Comment |
|---|---|---|---|
| Mag. ↑ ↑<br>Phase Ø° | Mag. ↑ ↓<br>Phase +90° | LV | No Switching Between Tx and Rcv |
| Mag. ↑ ↓<br>Phase +90° | Mag. ↑ ↑<br>Phase Ø° | LH | No Switching Between Tx and Rcv |
| Mag. ↑ ↑<br>Phase Ø° | Mag. ↑ ↑<br>Phase Ø° | LC | Must Switch Between Tx and Rcv |
| Mag. ↑ ↓<br>Phase −90° | Mag. ↑ ↓<br>+90° | RC | Must Switch Between Tx and Rcv |

FIGS. 7A-7F depict use of the RHYME radiator transceive sub-circuit 110. Here, the very same sort of analysis for LV and LH polarization transmit and receive mode operations can be discerned from FIGS. 6A-6D. For completeness, the reciprocal quarter wave plate 410 and non-reciprocal quarter wave plate 420 of radiator 306 are also depicted at the right-hand side of the FIGS. 7A-7E together with the vector representations 411 and 421 of signals at the exit face from each quarter-wave plate. For the case of LV and/or LH polarized radiation, these quarter-wave plates have no real effect as will be appreciated by those in the art.

However, in FIGS. 7E and 7F, it can be seen that the quarter wave plates 410, 420 perform their conventional function so as to transform orthogonal modes with appropriate phases into right circularly polarized (RC) radiation (or to decompose received RC radiation into suitable orthogonal components for coupling to coupling loops 308, 310). As will be observed, phase shifters 302,304 are in the 0° and 0° phase shift settings respectively for right circularly polarized radiation.

Figure 8:
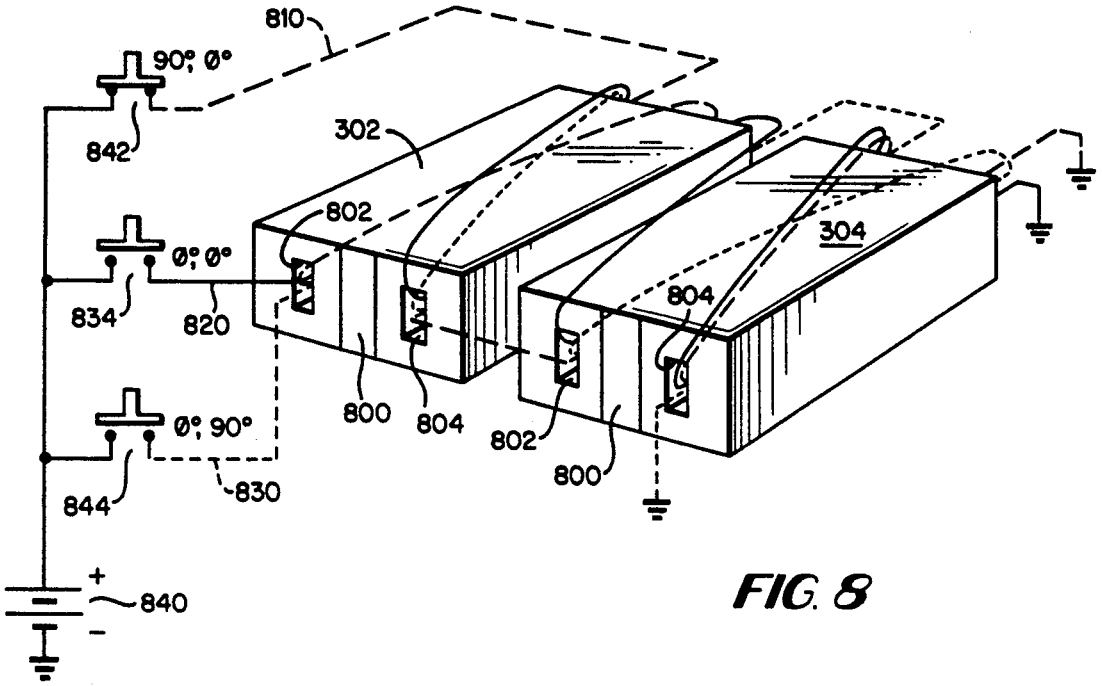
FIG. 8 is a schematic perspective view of exemplary latch wire driving and threading of the double toroid ferrite phase shifter structures utilized in the pair of 0°,90° latchable phase shifters employed in the exemplary embodiment of FIG. 3.

FIG. 8 depicts the rectangular waveguide portion of phase shifters 302, 304. Each waveguide includes the usual center dielectric slab 800 and pair of ferrite toroids 802,804. An exemplary pattern for winding latch wires 810, 820 and 830 through the toroid cores is also depicted in FIG. 8. A suitable power source 840 in conjunction with suitable conventional driving circuits and electronic switches (schematically depicted by simplified unipolar switches 842, 843 and 844) may be used in conjunction with a single sense wire to set the pair of phase shifters 302, 304 to appropriate pairs of phase shifting states. For example, in the latch wire threading pattern depicted at FIG. 8, latch wire 810 may be used to simultaneously set both phase shifters 302, 304 to produce forward-direction (i.e., transmit) phase shifts of 90° and 0° respectively. Similarly, latch wire 820 may be used to set the pair of phase shifters 302, 304 to the forward direction phase states 0°,0° and latch wire 830 may be used to set the pair of phase shifters 302,304 to the forward direction phase states 0°,90° respectively. As will be appreciated the actual drive circuits would be capable of bi-polar operation so as to establish a current pulse of the correct magnitude, duration and polarity to set a proper magnitude and polarity of remnant flux in the ferrite toroids.

Figure 9:
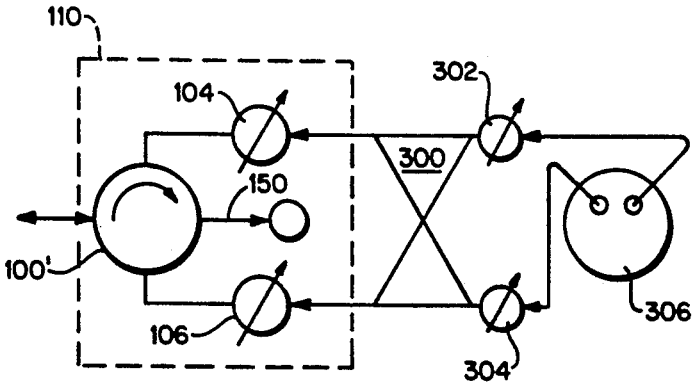
FIG. 9 is a schematic depiction of yet a further modification to the embodiment of FIGS. 7A–7E wherein a four port circulator is used in the RHYME transceive sub-circuit to provide a received orthogonal polarization port.

In FIG. 9, the usual RHYME radiator transceive sub-circuit 110 has been modified so that circulator 100' has a fourth port 150 disposed between the usual transmit/receive RF channel ports. When this arrangement is used in connection with circularly polarized radiation, port 150 provides for reception of any incoming radiation having orthogonal circular polarization to that for which the RF radiator module is currently set.

The embodiment of FIGS. 10 and 11A-11F represents an alternative embodiment wherein the waveguides of the hybrid mode phase shifters 302,304 are stacked one on top of the other (on opposite sides of a common ground plane) and used to directly feed a square waveguide radiator 306'. Here, a conventional septum polarizer is utilized to provide dual mode orthogonal radiation modes rather than a pair of orthogonal coupling loops. A more complete understanding of this reciprocal phase shifter arrangement of a pair of phase shifters in a square geometry coupled to a septum polarizer can be had from related U.S. Pat. No. 4,884,045—Alverson et al referenced above. The operation of the dielectric quarter-wave plate 410' and of the non-reciprocal ferrite quarter-wave plate 420' is as previously discussed. Cross-sectional depictions are depicted at FIGS. 10A-10C as should now be apparent. The arrayed waveguides of phase shifters 302,304 are also depicted in cross-section on opposite sides of a common ground plane 1100 in FIGS. 11A-11F.

Here, the microstrip to square waveguide transition is accomplished with the hybrid mode phase shifters 302,304 directly. There is, of course, a transmit and receive microstrip line present at the other ends of phase shifters 302, 304. This polarization switching technique differs from others in part because it requires a septum polarizer. Furthermore, since the phase shifters 302, 304 are arrayed on top of one another on opposing sides of the common ground plane, the microstrip feedlines to the other end of the hybrid mode phase shifters 302, 304 must have one of these lines routed through the ground plane substrate so as to interface with the hybrid mode 90° phase shifter located on the opposite side from the remainder of the microstrip circuitry (e.g., the 90° Lange microstrip hybrid, the other conventional phase shifting circuits, etc.).

As may be seen by inspection of the FIG. 11A, the representative phase settings for phase shifters 302,304 and the usual vector notations introduced for other embodiments, a transmit mode for linear vertical polarized radiation can be obtained by setting phase shifters 302,304 to the 0° and 90° phase states respectively. Similarly, a receive mode for the same polarization can be automatically achieved since the phase shifters 302,304 are already in reverse or receive direction 90°,0° phase states respectively. Transmit and receive modes for linear horizontal polarizations are just the reverse as depicted in FIGS. 11C and 11D. For transmitting left circular (LC) polarization, phase shifters 302, 304 are set to the 0° and 0° phase states respectively as depicted in FIG. 11E. For receiving left circularly polarized radiation, phase shifters 302, 304 are thus already at the proper reverse or receive direction 90° and 90° phase states respectively as depicted at FIG. 11F.

Figure 12:
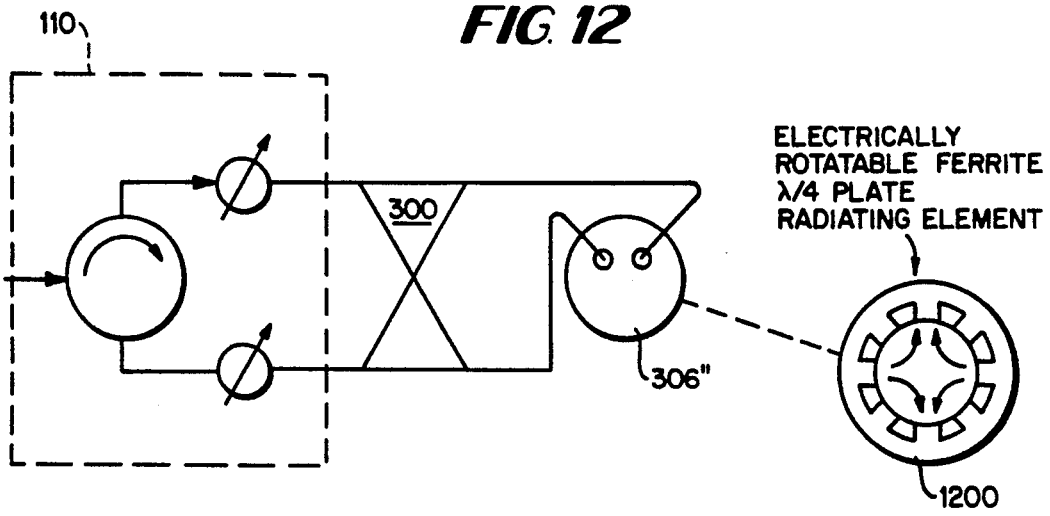
FIG. 12 is a schematic depiction of yet another embodiment of this invention wherein a 90° Lange hybrid microstrip coupling circuit is used in conjunction with an electrically rotatable ferrite quarter wave plate radiating element to achieve linear polarization agility.
Figure 13:
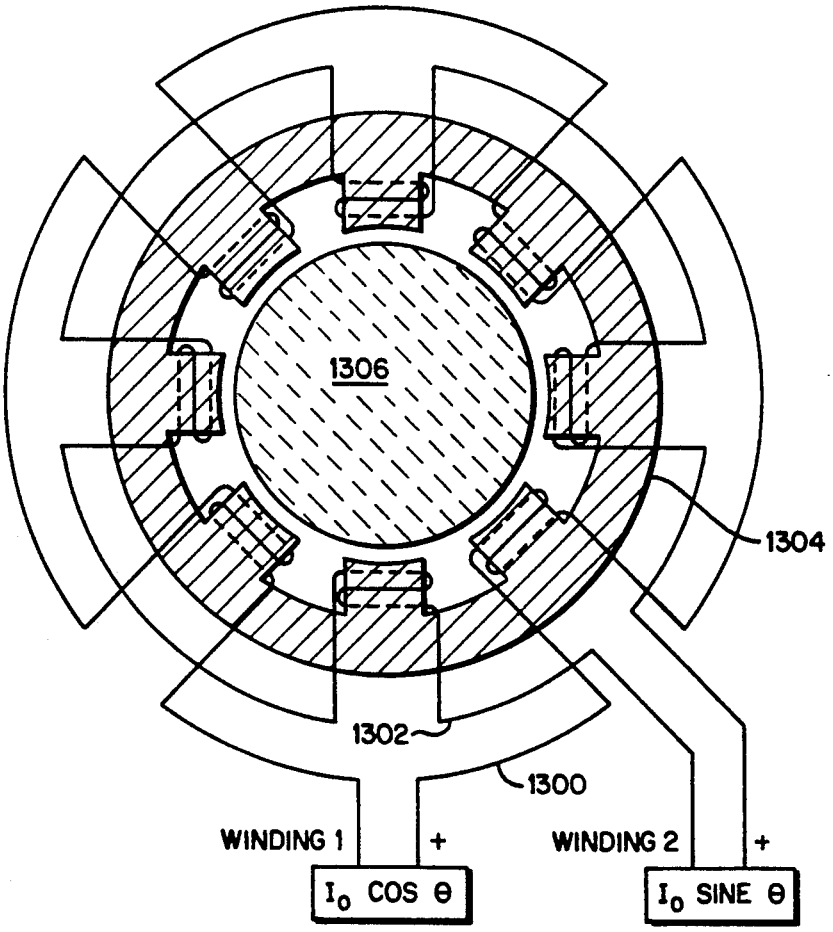
FIG. 13 is a schematic depiction of the electrically rotatable ferrite quarter wave plate radiating element so as to better explain the generation of rotatable fields in the quarter wave plate ferrite material.

Yet another embodiment is depicted at FIG. 12. Here the 0°,90° phase shifters 302, 304 are omitted and an electrically rotatable ferrite quarter-wave plate radiating element 1200 is employed in the circular waveguide radiator 306''. The current loops 310'' and 308'' for the radiator are connected to ports of the 90° Lange hybrid microstrip coupling circuit 300. The quadupole field of radiator element 1200 may be electrically rotated to produce any linear polarization from linear vertical to linear horizontal. This permits transmission of any desired linear polarization and reception of the same polarization while also achieving desired duplexing operation. The rotary field device itself as a half-wave plate device has previously been described by Fox, A. G., "Adjustable Waveguide Phase Changer," *Proceedings IRE*. Vol. 35, December 1947 and Fox et al, "Behavior and Application of Ferrites," *The Bell System Technical Journal*, Vol. XXXIV, No. 1, January 1955. The presently utilized quarter-wavelength version of this device is depicted at FIG. 13. Like its half-wave cousin, it utilizes two windings 1300, 1302 located on a stator yoke 1304 surrounding a completely filled ferrite circular waveguide 1306 as depicted in cross-section and in schematic form at FIG. 13. Windings 1300, 1302 are associated with alternate poles of yoke 1304 and excited with respective sine and cosine current functions as indicated in FIG. 13. When winding currents are varied as the sine and cosine, the field will rotate and therefore the linearly polarized wave emanating from this quarter wave plate radiator will also rotate. Duplexing may be accomplished because such rotary field quarter wave plate is inherently non-reciprocal. At the same time, it is non-latching and also slow to switch. It will be appreciated by those in the art, that by properly phasing the sine and cosine currents applied to these two windings, proper rotation of the polarization may be obtained.

FIGS. 12A–12D use the same nomenclature already explained to analyze the operation of the FIG. 12 circuit for both transmit and receive modes in linear vertical and linear horizontal radiation modes. It should be appreciated that any rotation of this linear polarization can be achieved by suitably exciting the windings in the electrically rotatable ferrite quarter wave plate radiator 1200.

If the MMIC radiator transceive sub-circuit 110 is utilized in conjunction with a notched radiator, then polarization agile operation over a very broad bandwidth (e.g., 3 to 1) should be possible. Such an approach may produce approximately the same overall insertion losses as the use of the duplexing output circulator 102 being replaced by these polarization agile circuits.

To attain the fastest possible switching of the latchable phase shifters 302, 304, the "up-up" switching technique of the driver described in related U.S. Pat. No. 5,089,716 may be utilized. The non-reciprocal ferrite quarter wave plate could have other conventional (e.g., electrically "long") states of magnetization so as to achieve the desired difference in propagation constants for LV and LH polarized inputs components (thereby causing the output to be polarized as a function of phase difference as will be recognized by those in the art). In such circumstances, it may be necessary to use 90°,90° phase states for phase shifters 302, 304 in the receive mode and 0° 0° phase states for these phase shifters in the transmit mode. However, the operation of the polarization switch or phase gradient for the phased array can still be attained as should be appreciated by those in the art.

In the preferred exemplary embodiment, the latchable phase shifters 302, 304 may be capable of switching in less than one microsecond and require less than 20 microjoules to switch at either X-band or Ku-band frequencies. This is believed to be an advantage over prior techniques (e.g., using Faraday rotators, switchable quarter-wave plates, etc.). Furthermore, the polarization switching schemes described above are microstrip compatible and therefore can be used in conjunction with either conventional RHYME or MMIC radiator transceive sub-circuits. Furthermore, the cross-sectional dimensions of the entire polarization agile RF radiator modules are well within the range of inter-element spacings typically required in phased arrays at either X-band or Ku-band frequencies (e.g., less than about 0.6 wavelength).

Additional RF loses required to achieve polarization agility in accordance with at least some embodiments of this invention are presently estimated to be on the order of only about 0.2 dB (e.g., assuming that the conventional RHYME or MMIC radiator transceive sub-circuits 110 are employed as discussed above) The 0.2 dB value has been estimated by calculating and comparing losses using a duplexing output circulator 102 as done conventionally on the one hand and a polarization switch using latchable phase shifters 302, 304, etc., as previously described. For example, consider the following calculation:

TABLE 1

| | |
|---|---|
| Additional Loss For Polarization Diversity | |
| Replaces Output Circulator | 0.4dB at 7–11 GHz<br>0.25dB at 9–9.5 GHz |
| (a) Narrow Band Requirement at 9.0–9.5 GH2z | |
| 90° Hybrid | 0.15dB |
| Phasers (0°, 90°) | 0.15dB |
| λ/4 plates | 0.10dB |
| | 0.4dB–0.25 = 0.15dB |
| (b) Broad Band Requirement at 7–11 GH2 | |
| 90° Hybrid | 0.20dB |
| Phasers (0° 90°) | 0.20dB |
| λ/4 plates | 0.20dB |
| | 0.60dB–0.4dB = 0.20dB |

As will be appreciated, if only LV and LH polarization diversity is desired, then the quarter-wave plates may be eliminated and the estimated additional insertion loss suffered to achieve such polarization diversity may be only on the order of 0.05 dB.

A polarization switch according to this invention may include a microstrip input feeding a dual-polarized notch radiating element. Such device will selectively transmit and receive LV or LH polarization and also accomplish duplexing at the following presently estimated specifications:

| PARAMETER | VALUE |
|---|---|
| Frequency Range | 7–11 GHz |
| Insertion Loss | <0.5 dB |
| VSWR | <1.2:1 |
| Switching Time | <0.5 μsec |
| Switching Energy | <15 μjoules |
| Peak Power | 200W |
| Average Power | 20W |
| Size | 0.5 × 0.2 × 0.5 |
| Weight | <2 gm |

Although only a few exemplary embodiments of this invention have been described in detail, those skilled in the art will recognize that many variations and modifications may be made in these exemplary embodiments while yet retaining many of the novel features and advantages of this invention. Accordingly, all such variations and modifications are intended to be included within the scope of the appended claims.

What is claimed is:

1. A polarization agile RF radiator module for use in a phased array, said module comprising:

an RF radiator structure capable of supporting at least two orthogonal modes of RF propagation and coupled to an arrangement of (i) a pair of parallel latchable hybrid phase shifters in series with (ii) a 90° Lange hybrid microstrip coupling circuit.

2. A polarization agile RF radiator module as in claim 1 wherein:

said RF radiator structure includes two orthogonal conductive loops in a waveguide;

each hybrid non-reciprocal latchable ferrite waveguide phase shifter being selectively latchable to produce 0° and 90° relative phase shifts;

a first one of said phase shifters is coupled between a first terminal of the 90° Lange hybrid microstrip coupling circuit and a first one of said loops; and a second one of said phase shifters is coupled between a second terminal of the 90° Lange hybrid microstrip coupling circuit and a second one of said loops.

3. A polarization agile RF radiator module as in claim 2 wherein said waveguide includes, in series from said loops, a reciprocal dielectric quarter wave plate and a non-reciprocal fixed ferrite quarter wave plate.

4. A polarization agile RF radiator module as in claim 2 or 3 wherein said loops are disposed within a solid dielectric material within said waveguide.

5. A polarization agile RF radiator module as in claim 2 or 3 wherein said radiator structure includes a cylindrical waveguide and wherein said 90° Lange hybrid microstrip coupling circuit and said pair of phase shifters are disposed on a common printed circuit board which is affixed behind the radiator and generally parallel to the cylindrical waveguide axis.

6. A polarization agile RF radiator module as in claim 2 wherein said conductive loops are disposed at one end of a cylindrical waveguide having a reciprocal dielectric medium and a non-reciprocal ferrite medium, the conductive loops each having at least one leg extending through an insulated aperture at said one end of the waveguide and connected to said microstrip input port of a respectively associated one of said phase shifters.

7. A polarization agile RF radiator module as in claim 2 further including a radiator transceive circuit in a cascaded connection with said 90° coupling circuit.

8. A polarization agile RF radiator module as in claim 7 wherein said radiator transceive circuit comprises:

a microstrip RF circulator;

a common transmit/receive port connected to a first terminal of said circulator;

a latchable transmit phase shifter connected between a second terminal of said circulator and a third terminal of said 90° Lange hybrid microstrip coupling circuit; and a latchable receive phase shifter connected between a third terminal of said circulator and a fourth terminal of said 90° Lange hybrid microstrip coupling circuit.

9. A polarization agile RF radiator module as in claim 8 further comprising an orthogonal mode receive port connected to a fourth terminal of said circulator located between said second and third terminals of said circulator.

10. A polarization agile RF radiator module as in claim 7 wherein said radiator transceive circuit comprises a MIC having:

a selectively controllable phase shifter;

a controllable transmit/receive switch, said phase shifter operatively coupled in series with said switch;

a transmit amplifier coupled to one port of said switch to define a transmit branch RF circuit coupled to a third terminal of said 90° Lange hybrid microstrip coupling circuit; and a receive amplifier coupled to another port of said switch to define a receive branch RF circuit coupled to a fourth terminal of said 90° Lange hybrid microstrip coupling circuit.

11. A polarization agile RF radiator module as in claim 7 wherein said radiator transceive circuit comprises a MMIC having:

a selectively controllable phase shifter;

a controllable transmit/receive switch, said phase shifter operatively coupled in series with said switch;

a transmit amplifier coupled to one port of said switch to define a transmit branch RF circuit coupled to a third terminal of said 90° Lange hybrid microstrip coupling circuit; and a receive amplifier coupled to another port of said switch to define a receive branch RF circuit coupled to a fourth terminal of said 90° Lange hybrid microstrip coupling circuit.

12. A polarization agile RF radiator module as in claim 1 wherein said RF radiator structure is a square waveguide fed directly by a stacked array of waveguide toroids defining at least part of said pair of phase shifters.

13. A polarization agile RF radiator module as in claim 12 wherein said RF radiator structure comprises, in series from said phase shifters, a septum polarizer, a reciprocal dielectric quarter wave plate and a non-reciprocal ferrite quarter wave plate.

14. A polarization agile RF radiator module as in claim 12 wherein said pair of phase shifters are disposed on opposite sides of a common ground plane.

15. A polarization agile RF radiator module as in claim 1 wherein said pair of phase shifters are linked to be commonly and simultaneously set in one of three combined states characterized by: a first state that, when activated, sets the pair of phase shifters to produce 0° and 90° relative phase shifts, respectively, a second state, when activated, sets the pair of phase shifters to produce the same relative phase shifts, respectively, and a third state, when activated, sets the pair of phase shifters to produce 90° and 0° relative phase shifts, respectively.

16. A polarization agile RF radiator module as in claim 15 wherein said pair of phase shifters are interconnected by each of three separately activable latch wires.

17. A polarization agile duplex RF radiator module for use in a phased array, said module comprising:

a 90° microstrip coupling circuit having four terminals where RF signals input to any one terminal are passed at reduced amplitude to adjacent terminals with relative phase shifts of 0° and −90° and simultaneously isolated from the remaining terminal;

a first controllable hybrid mode latchable phase shifter connected at one end with a first one of said four terminals of said 90° microstrip coupling circuit;

a second controllable hybrid mode latchable phase shifter connected at one end with a second one of said four terminals of said 90° microstrip coupling circuit, adjacent said first terminal;

a first RF radiator structure coupled to an opposite end of said first hybrid mode phase shifter; and a second RF radiator structure disposed orthogonal to said first RF radiator structure and coupled to an opposite end of said second hybrid mode phase shifter.

18. A polarization agile duplex RF radiator module for use in a phased array, said module comprising:

a microstrip hybrid coupler having four terminals;

a first controllable hybrid mode latchable phase shifter connected in series with a first terminal of said microstrip hybrid coupler;

a second controllable hybrid mode latchable phase shifter connected in series with a second terminal of said microstrip hybrid coupler;

a first RF radiator structure coupled to a third terminal of said microstrip hybrid coupler; and a second RF radiator structure disposed orthogonal to said first RF radiator structure and coupled to a fourth terminal of said microstrip hybrid coupler.

19. A method for changing the polarization of RF signals transmitted and received by an RF radiator module in a phased array, said method comprising:

(a) feeding RF electrical signals to/from an RF radiator structure capable of supporting at least two orthogonal modes of RF propagation via an arrangement of a pair of parallel latchable phase shifters in series with a 90° coupling circuit; and (b) switching said pair of phase shifters from one of the following set of polarization phase states to another: (0°, 90°), (90°, 0°), and (0°, 0°).

20. A method as in claim 19 wherein each of said phase shifters has the capability of 0° and ±90° of phase shift wherein said method includes switching the pair of phase shifters between the (0°, 0°) phase state and the (−90°, +90°) phase state during a period between RF transmit and RF receive modes of operation for circularly polarized modes.

21. A method as in claim 19 wherein said radiator structure includes a waveguide having, in series from a pair of coupling loops coupled to the cascade arrangement, a reciprocal dielectric quarter wave plate and comprising the step of passing RF signals to/from the coupling loops within the waveguide via said quarter-wave plates.

22. A method as in claim 19 wherein in step B said pair of phase shifters are simultaneously set in one of three combined states characterized by: a first state, when activated, sets the pair of phase shifters to produce 0° and 90° relative phase shifts respectively, a second state when activated, sets the pair of phase shifters to produce the same relative phase shifts, respectively, and a third state when activated, sets the pair of phase shifters to produce 90° and 0° relative phase shifts, respectively.

23. A method as in claim 19 wherein said RF radiator structure is a square waveguide comprising and wherein step (a) further comprises feeding said square waveguide directly by a stacked array of waveguide toroids forming at least part of said pair of phase shifters.

24. A method for achieving RF signal polarization agility using an RF radiator module in a phased array, said method comprising:

(a) feeding RF signals to an RF radiator structure capable of supporting at least two orthogonal modes of RF propagation via two orthogonal conductive loops each coupled to a respectively associated terminal of a 90° Lange hybrid microstrip coupling circuit; and (b) changing the polarity of the RF signals by electrically rotating a ferrite quarter-wave plate including a multi-poled, magnetically permeable, yoke structure having first and second electrical windings wound on alternate sets of yoke pole pieces surrounding a ferrite core disposed within a circular waveguide as part of said radiator structure and coupled to the conductive loops.

25. A polarization agile RF radiator module for use in a phased array, said module comprising:

an RF radiator structure capable of supporting at least two orthogonal modes of RF propagation, said modes excited by two orthogonal conductive loops each connected to a respectively associated terminal of a 90° Lange hybrid microstrip coupling circuit;

said RF radiator structure comprising a circular waveguide coupled to said conductive loops, said circular waveguide having an electrically rotatable ferrite quarter-wave plate including a multi-poled, magnetically permeable, yoke structure having first and second electrical windings wound on alternate sets of yoke pole pieces surrounding a ferrite core.

* * * * *